US010741932B2

(12) United States Patent
Thai et al.

(10) Patent No.: US 10,741,932 B2
(45) Date of Patent: Aug. 11, 2020

(54) COMPACT RADIO FREQUENCY (RF) COMMUNICATION MODULES WITH ENDFIRE AND BROADSIDE ANTENNAS

(71) Applicant: INTEL IP CORPORATION, Santa Clara, CA (US)

(72) Inventors: Trang Thuy Thai, Hillsboro, OR (US); Sidharth Dalmia, Portland, OR (US); Jonathan C. Jensen, Portland, OR (US); Josef Hagn, Munich (DE); Baljit Singh, San Jose, CA (US); Bhagyashree S. Ganore, Hillsboro, OR (US); Daniel Roberts Cox, Portland, OR (US); Evan A. Chenelly, Portland, OR (US)

(73) Assignee: Intel IP Corporation, Santa Clara, CA (US)

( * ) Notice: Subject to any disclaimer, the term of this patent is extended or adjusted under 35 U.S.C. 154(b) by 140 days.

(21) Appl. No.: 16/146,672

(22) Filed: Sep. 28, 2018

(65) Prior Publication Data

US 2019/0103682 A1 Apr. 4, 2019

Related U.S. Application Data

(60) Provisional application No. 62/566,379, filed on Sep. 30, 2017.

(51) Int. Cl.
*H01Q 1/02* (2006.01)
*H01Q 21/06* (2006.01)
(Continued)

(52) U.S. Cl.
CPC ..... *H01Q 21/064* (2013.01); *H01Q 1/02* (2013.01); *H01Q 1/243* (2013.01); *H01Q 1/38* (2013.01);
(Continued)

(58) Field of Classification Search
CPC ..... H01Q 21/064; H01Q 5/392; H01Q 1/02; H01Q 1/243; H01Q 1/38; H01Q 1/526;
(Continued)

(56) References Cited

U.S. PATENT DOCUMENTS

2014/0266973 A1 9/2014 Devries

FOREIGN PATENT DOCUMENTS

JP 07-203514 A 8/1995
JP 5166070 B2 3/2013
(Continued)

OTHER PUBLICATIONS

International Search Report for Related PCT Application PCT/US2017/054662 filed Sep. 30, 2017 dated Jun. 29, 2018, 3 pages.

*Primary Examiner* — Graham P Smith
(74) *Attorney, Agent, or Firm* — International IP Law Group, P.L.L.C.

(57) ABSTRACT

The techniques described herein relate to a Radio Frequency (RF) communication module for a hand-held mobile electronic device. The Radio Frequency (RF) communication module includes a circuit board and a plurality of antennas disposed on a top side and bottom side of the circuit board. The plurality of antennas comprise a first subset of antennas comprising end-fire antennas and a second subset of antennas comprising broadside antennas. The first subset of antennas and the second subset of antennas also have a bandwidth of approximately 40 percent. The Radio Frequency (RF) communication module also includes a shielded area comprising circuitry coupled to the circuit board for controlling the antennas.

25 Claims, 43 Drawing Sheets

(51) Int. Cl.

| | |
|---|---|
| ***H01Q 13/16*** | (2006.01) |
| ***H01Q 1/52*** | (2006.01) |
| ***H01Q 5/392*** | (2015.01) |
| ***H01Q 1/24*** | (2006.01) |
| ***H01Q 9/28*** | (2006.01) |
| ***H01Q 19/28*** | (2006.01) |
| ***H01Q 1/38*** | (2006.01) |
| ***H01Q 21/28*** | (2006.01) |
| ***H01Q 9/04*** | (2006.01) |

(52) U.S. Cl.
CPC ..... *H01Q 1/526* (2013.01); *H01Q 5/392* (2015.01); *H01Q 9/0414* (2013.01); *H01Q 9/28* (2013.01); *H01Q 13/16* (2013.01); *H01Q 19/28* (2013.01); *H01Q 21/28* (2013.01)

(58) Field of Classification Search
CPC ..... H01Q 9/0414; H01Q 9/28; H01Q 13/16; H01Q 19/28; H01Q 21/28
See application file for complete search history.

(56) References Cited

FOREIGN PATENT DOCUMENTS

| | | |
|---|---|---|
| JP | 5413921 B2 | 2/2014 |
| JP | 5725571 B2 | 5/2015 |

200

300

500

700

1000

1000

1100

1200

1400

1500

1900

2000

2008

2200

2300

2400

2500

2600

2700

2800

2900

3000

3100

3200

3400

3500

3600

COMPACT RADIO FREQUENCY (RF) COMMUNICATION MODULES WITH ENDFIRE AND BROADSIDE ANTENNAS

TECHNICAL FIELD

This disclosure relates generally to perpendicular end fire antennas for electronic devices. More specifically, this disclosure relates to perpendicular end fire antennas for hand-held electronic devices such as smart phones, tablet PCs, and the like.

BACKGROUND

The number of integrated wireless technologies included in mobile computing devices is increasing. These wireless technologies include, but are not limited to, WIFI, WiGig, mmWave, and Wireless Wide Area Network (WWAN) technologies such as Long-Term Evolution (LTE). The small size and the limited battery power available in such devices presents challenges when incorporating several antennas with suitable performance characteristics.

BRIEF DESCRIPTION OF DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DETAILED DESCRIPTION

Figure 1:
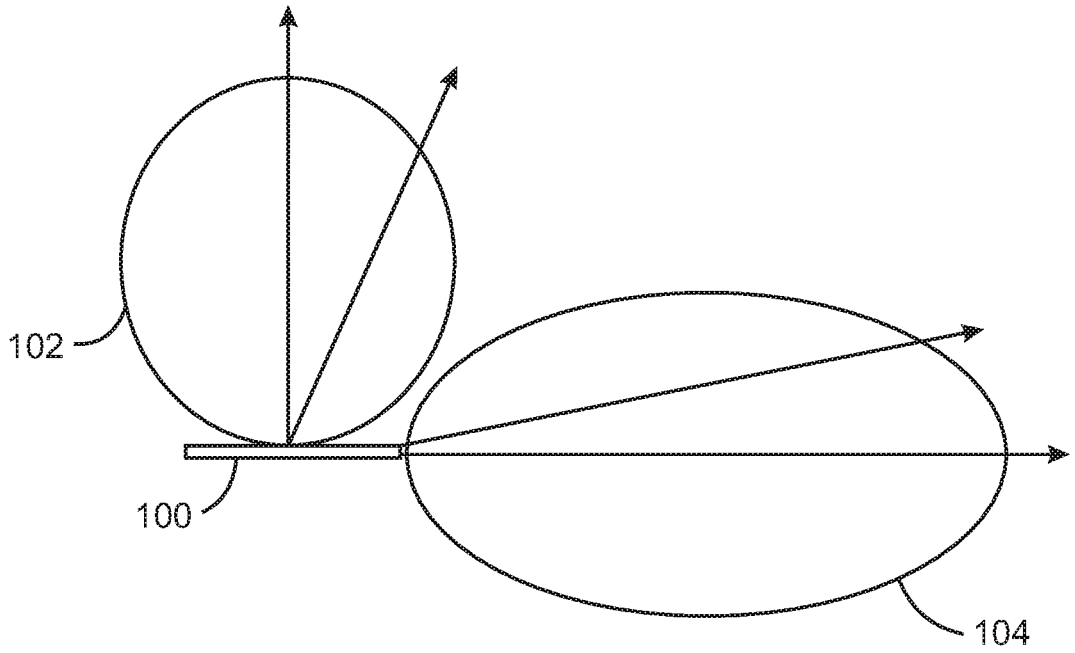
FIG. 1 is a cross sectional view of mobile electronic device with antenna radiation coverage.

The subject matter disclosed herein relates to techniques for incorporating antennas into electronic devices, including small portable user devices such as smart phones and tablet PCs, for example. Smart phones often use thin patch antennas that are disposed on the platform's Printed Circuit Board (PCB) in a parallel configuration, meaning that the plane of the radiating element is parallel to the plane of the platform's PCB. The overall antenna geometry of such parallel patch antenna designs results in radiation that is primarily in the broadside direction, i.e., perpendicular to the plane of the device's PCB. The radiation in the end fire direction, i.e., parallel to the plane of the device's PCB, is substantially lower compare to the broadside direction. For example, using a 350 micrometer (um) thick stacked patch antenna operating at 60 Gigahertz (GHz), the difference of signal strength between broadside and end fire directions may be between 8 decibel isotropic (dBi) to 13 dBi.

High frequency communications, such as mmWave, suffer from high free space path loss. Antenna array beamforming can be used to compensate this loss by increasing the antenna gain. However, user devices such as smart phones are highly mobile and therefore subject to being held at a variety of different orientations. Embodiments of the present techniques provide 360 degree antenna coverage to account for the device mobility. More specifically, various antenna designs are described which can be incorporated in a user device to provide both broadside and end-fire radiation relative to the phone's planar face. In this way, the antenna gain can be increased in the direction of other devices that that the device is attempting to communicate with, such as WiFi access points, cell towers, and others.

Additionally, various embodiments of the present techniques provide an antenna that has a wide bandwidth while remaining compact in size. For example, the antennas described herein exhibit a wide bandwidth that is able to cover both the 28 GHz band and the 39 GHz band in 5G mmWave solutions. The antenna component is often the largest elements in the RF system. Having a wideband end-fire antenna solution improves frequency diversity for improved reliability, reduces the antenna count per platform, minimizes the RF package size, and allows more space for the antenna array to provide more effective beam scanning coverage.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other, i.e. near field coupling.

In some embodiments, an electronic device may include three different types of antenna designs, including a wideband open slot antenna for end-fire radiation, a wideband open slot antenna for broadside radiation, and a high gain wide band printed bowties antenna. Each antenna type complements the overall coverage for communication channels such as 5G channels. In this way, the number of antenna elements required to achieve certain array gain can be reduced. For example, all three antenna types are capable of dual-polarization for MIMO channels, and can provide near 180 degree coverage around the sides of the device.

Effectively, this architecture allows a coverage of near 270 degree solid angle. Furthermore, all antennas (both broadside and end-fire) in this system can be configured in the signal processing stage for any combination of beam forming (broadside+broadside, broadside+endfire, endfire+endfire arrays, etc.). Additionally, the use of wideband end-fire and broadside antenna enable antenna system performance capable of the desired spatial coverage that can operate in both 28 GHz and 39 GHz frequency bands to simplify and minimize the antenna count for a robust and highly capable 5G systems. In this way, the number of antenna elements required to achieve certain array gain can be reduced. Additionally, the integration of the antennas to cover 270 degree solid angle based on beam forming can provide the ability to determine angle of arrival of the signals coming from other devices. This information can be used as sensing in various applications for the mobile devices.

FIG. 1 is a cross sectional view of mobile electronic device with antenna radiation coverage. The mobile device 100 may be a smart phone, tablet computer, and the like. FIG. 1 also shows example radiation patterns that can be achieved using the antenna types described herein. As shown in FIG. 1, the mobile device's antenna system provides a radiation pattern 102 oriented primarily in the broadside direction, i.e., perpendicular to the plane of the device's PCB. The mobile device's antenna system provides a radiation pattern 104 oriented primarily in the end fire direction, i.e., parallel to the plane of the device's PCB.

The broadside and end fire antennas can be configured to cover multiple frequency ranges and can be configure as a Multiple-Input Multiple-Output (MIMO) antenna system. In some embodiments, the antenna system can be used to cover the low band (LB) and high band (HB) frequency ranges for Enhanced Data rates for GSM Evolution (EDGE). In EDGE, the low band covers a frequency range from 24 GHz to 33 GHz and the high band covers a frequency range from 37 GHz-43 GHz.

Additionally, the broadside and end fire antennas may be coupled to a common receiver and/or transmitter circuitry so that the antennas are able to form a single beamforming antenna array. This enables beamforming techniques that provide a wide range of coverage angle possibilities spanning approximately 270 degrees solid angle around the mobile device.

Figure 2:
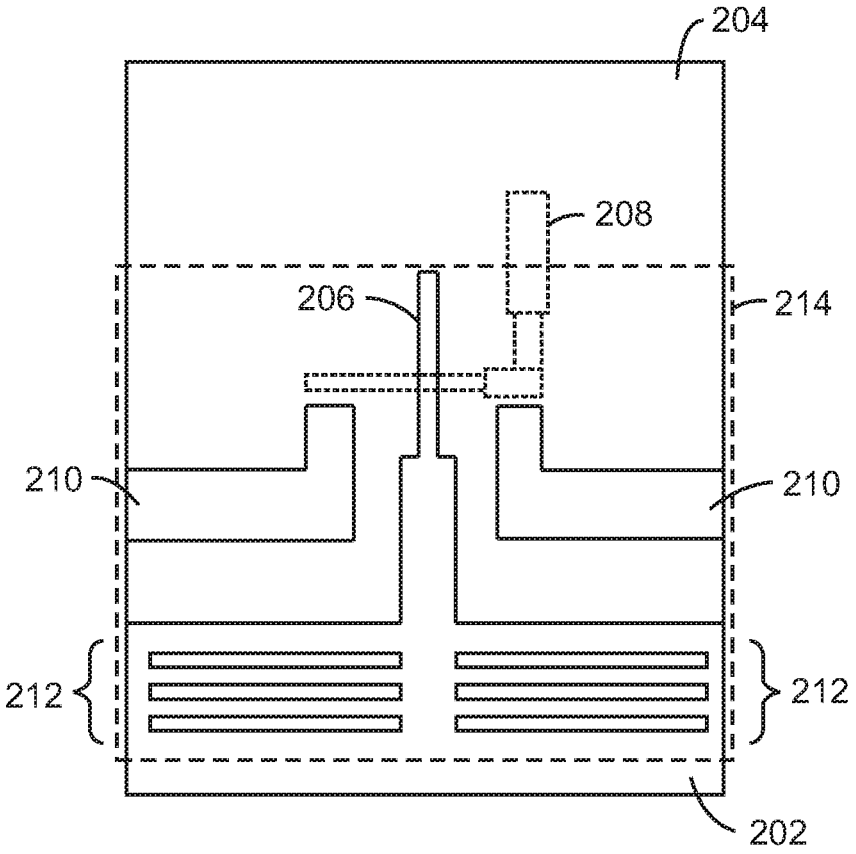
FIG. 2 is a top view of an open-slot end-fire antenna.

FIG. 2 is a top view of an open-slot end-fire antenna. The open slot antenna 200 may be formed by printing metal layers on the surface of a dielectric circuit substrate 202. The open slot antenna 200 includes a conductive ground plane 204 with a resonant slot 206 on one side of the circuit substrate. The open slot antenna 200 is fed by a microstrip signal line 208, which is disposed on the other side of the circuit substrate 202 and serves to excite the resonant slot 206. The microstrip signal line 208 and resonant slot 206 can include impedance steps that enable wide-band impedance matching. The microstrip signal line 208 excites the resonant modes of the open slot antenna via the stepped impedance slot lines.

The open slot antenna can also include two L-shape slots 210 that are formed in the sides of the ground plane 204. The L-shaped slots 210 reduce the current paths along the side edges which contribute to the back radiation, thus enhancing the directivity of the antenna in the end-fire direction. The L-shaped slots 210 also improve the impedance matching for the low frequency band.

The open slot antenna 200 can also include two sets of parasitic directors 212, which are placed on the same ground layer and positioned close to the opening of the aperture 206 that connects to the resonant edge 213, which functions as an open slot, a variation of the traditional close slot antenna. In this example, three parasitic directors are shown. However, in an actual implementation, the antenna 200 may include more or fewer parasitic directors, including 1, 2, 4, or more. The parasitic directors improve the directivity of the open slot antenna 200 in the end-fire direction and enhance matching for the high frequency band.

The active areas of each open slot antenna is designated as a "keep out" area, which is designated by the dashed box 214. Additional components may be included in the circuit substrate outside of the keep out area. In some embodiments, the keep out area may be as small as 2.2 mm×3.2 mm for the frequency range of 24 to 45 GHz.

Figure 3A:
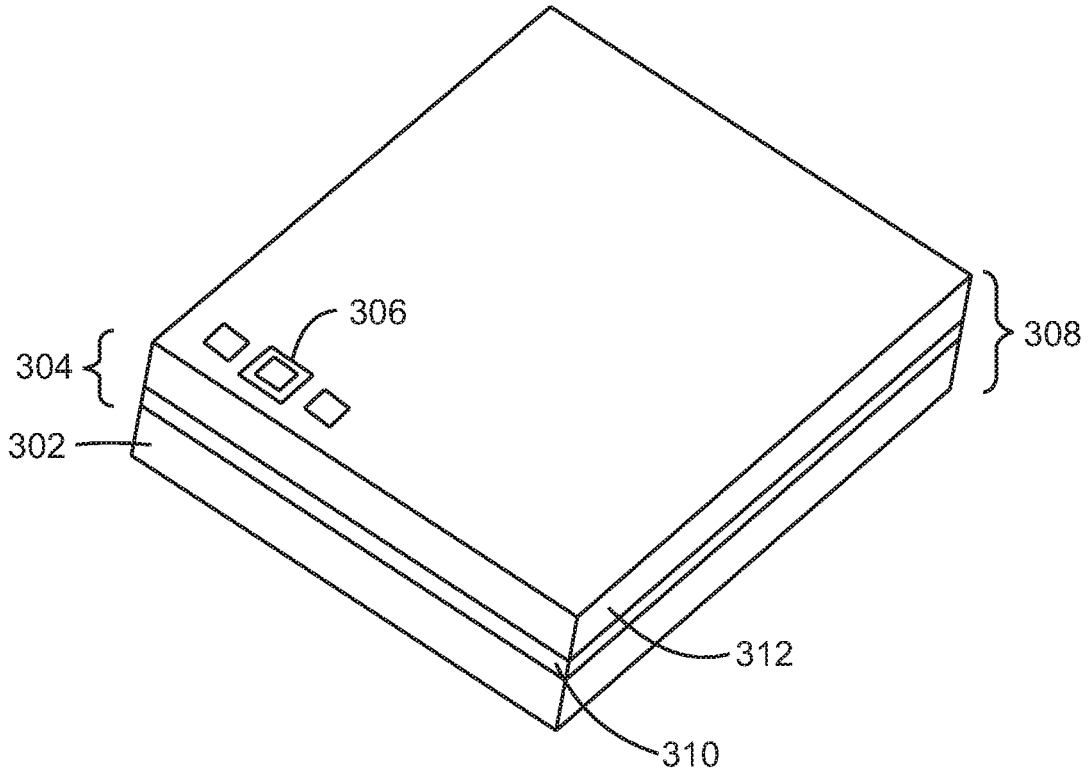
FIG. 3A is a perspective view showing stacked layers of an example end-fire open slot antenna.

FIG. 3A is a perspective view showing stacked layers of an example end-fire open slot antenna. In this example, the end-fire open slot antenna 300 is configured into a stackup with a portion embedded in a package substrate 302 and a portion assembled as a surface mount component 304. The stackup of the antenna uses through vias 306 to excite the resonant slot to allow ease of fabrication, low risk and high yield. This allows the antenna to maintain low z-height, suitable for 5G mobile applications when integrating into the RF module. The total z-height 308 can be as low as 0.44 mm assembled. The size of the antenna's footprint may be on the order of 3.0 mm by 2.5 mm.

In some examples, the package substrate 302 may be a dielectric material with relative permittivity of 3.5, and the surface mount component 304 may include a first dielectric layer 310 with relative permittivity of 6.0 and a second dielectric layer 312 with relative permittivity of 4.5. The metal layers that make up the open slot antenna and the feed structure are embedded between these dielectric layers as shown in FIGS. 3B and 3C.

Figure 3B:
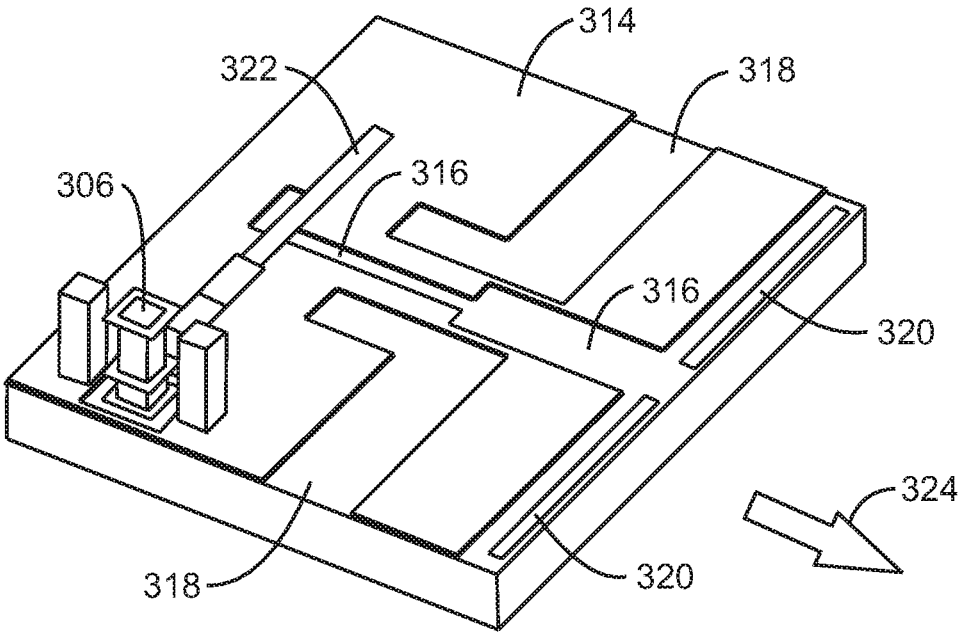
FIG. 3B is a top perspective view showing the end-fire open slot antenna of FIG. 3A.

FIG. 3B is a top perspective view showing the end-fire open slot antenna of FIG. 3A. In this view, the first dielectric layer 310 and second dielectric layer 312 have been eliminated to show the metal layers, including the conductive ground plane 314 with aperture 316 and open slot 317 and L-shaped slots 318. In this embodiment, the open slot antenna 300 also includes a pair of parasitic directors 320. Also shown in the microstrip feed line 322 which is coupled to the through via and extends over the excitation aperture slot 316, which provides the excitation for the open slot 317. Both the microstrip feed lines 322 and the excitation aperture 316 can utilize impedance stepping to improve the operation frequency bandwidth as demonstrated in this example. The parasitic director 320 can be 1, 2, or more in numbers to improve the directivity in the end-fire direction and improve matching for the high frequency band. The L-shape slots 318 improve matching for the low frequencies. In this example, the conductive ground plane 314 is disposed on top of the package substrate 302, and the microstrip feed line 322 is disposed over the first dielectric layer 310. As an end fire antenna, the peak radiation will be in the direction shown by arrow 324.

Figure 3C:
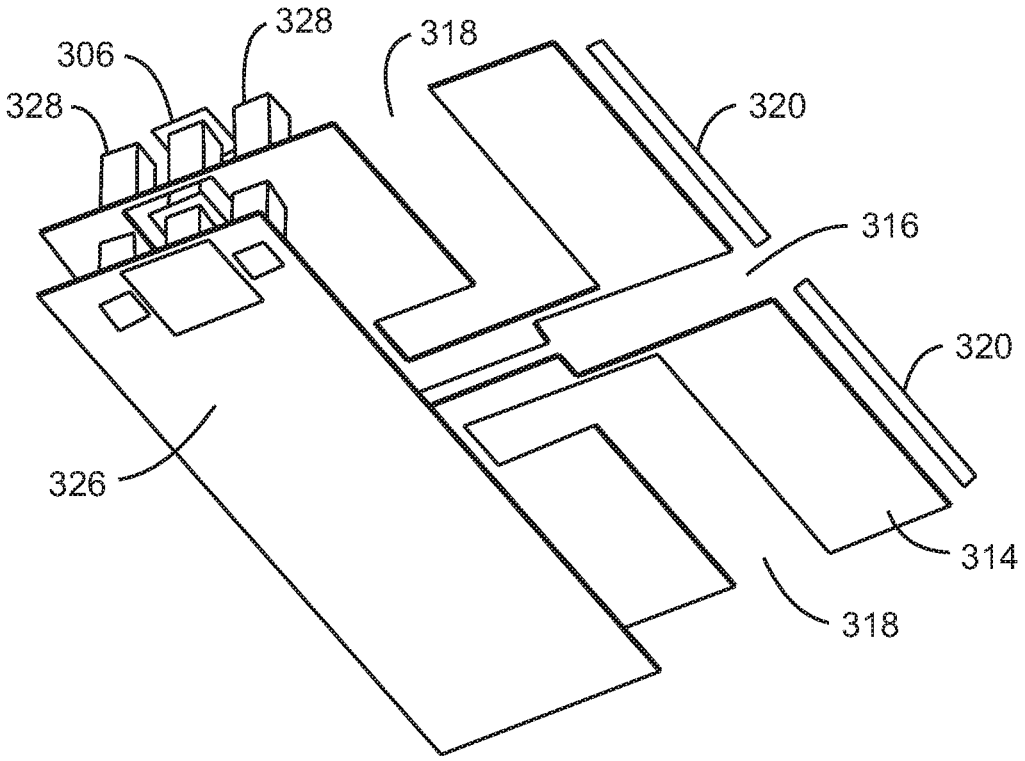
FIG. 3C is a bottom perspective view showing the end-fire open slot antenna of FIGS. 3A and 3B.

FIG. 3C is a bottom perspective view showing the end-fire open slot antenna of FIGS. 3A and 3B. In this view, the first dielectric layer 310, second dielectric layer 312, and the package substrate 302 have been eliminated to show only the metal layers. In this view, the package ground layer 326 is visible. The package ground layer 326 is coupled to the antenna's conductive ground plane 314 by plated through vias 328.

Figure 4:
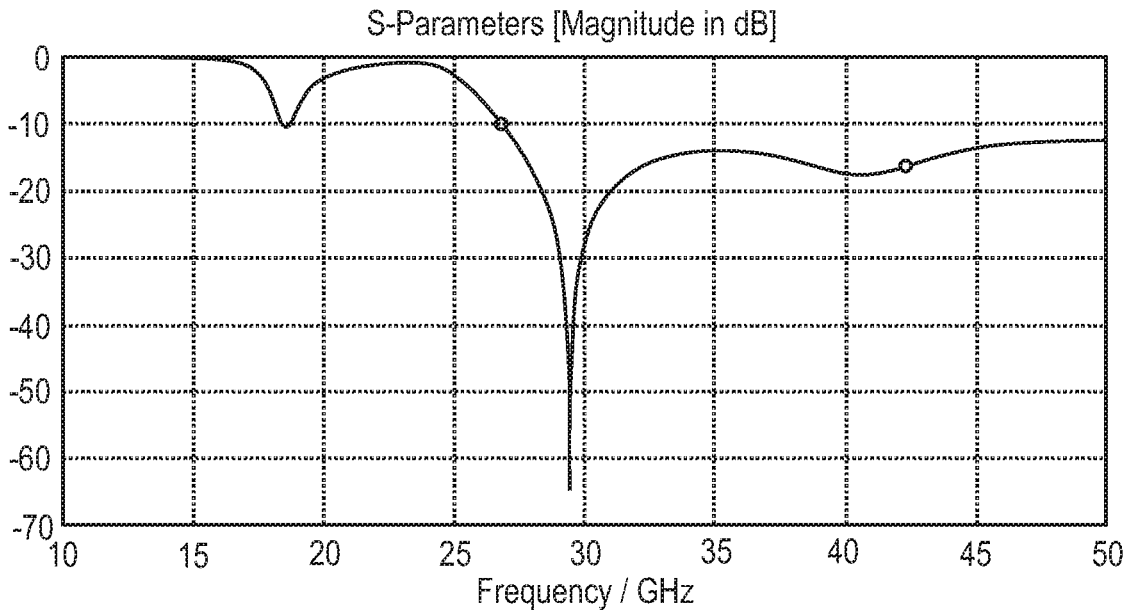
FIG. 4 is a graph of the return loss for the end-fire open slot antenna shown in FIGS. 3A-3C.

FIG. 4 is a graph of the return loss for the end-fire open slot antenna shown in FIGS. 3A-3C. As shown in FIG. 4, end-fire open slot antenna 300 can operate over a wide band of frequencies. In an example of embodiment, the antenna 300 may operate from 27 GHz to over 50 GHz. Additionally, the antennas realized gain (not shown), which includes radiation loss and mismatch, is from 4.5 to 5 dB for both frequencies of interests, i.e. 27 GHz and 42 GHz.

Figure 5:
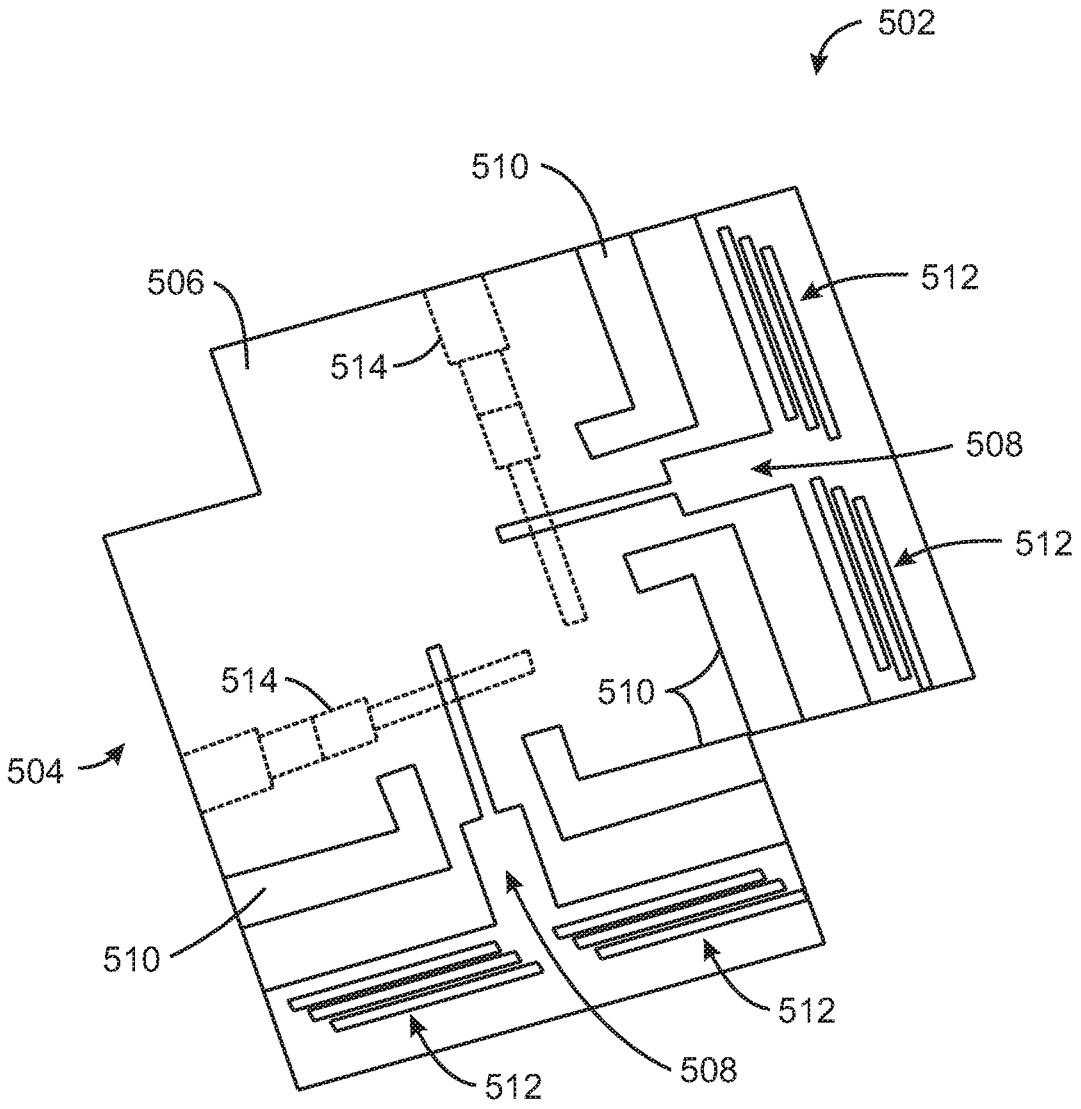
FIG. 5 is another example of an end-fire open slot antenna.

FIG. 5 is another example of an end-fire open slot antenna. In this example, the open slot antenna 500 is configured into a slanted (+45/−45) topology to provide dual polarization. The open slot antenna 500 may also be referred to herein as a V-shaped slot antenna. The open slot antenna 500 includes a first antenna element 502 configured to provide a first polarization and a second antenna element 504 configured to provide a second polarization. Each antenna element 502 and 504 is similar to the open slot antenna described in FIG. 2. The antenna elements 502 and 504 share a common conductive ground layer 506, with separate excitation aperture 508 and L-shaped slots 510 and resonant open slot 511 oriented at an angle of 90 degrees to one another. Each antenna element 502 and 504 may also include parasitic directors 512. As shown in FIG. 5, the parasitic directors 512 are positioned in a slanted configuration. The positions of the parasitic directors 512 may be changed to effect changes in the radiation pattern of the antenna 500. Each resonant slot 511 is excited by a separate aperture 508, which is fed by a separate feedline 514, which is disposed on the bottom surface the of the circuit substrate.

The performance of this dual polarization V-shape slot antenna provides wideband characteristics similar to the open slot antenna shown in FIGS. 3A-3C. Isolation between two polarizations may be approximately 10 to 15 dB in the 27 to 30 GHz range and 25 dB in the 39 to 40 GHz range. The V-shaped antenna 500 also provides wideband performance (return loss less than −10 dB) and high isolation (greater than 20 dB) in a large range of frequencies from 32 GHz-45 GHz. The antenna can be further tuned to adjust this bandwidth to the frequency range of interest.

Figure 6:
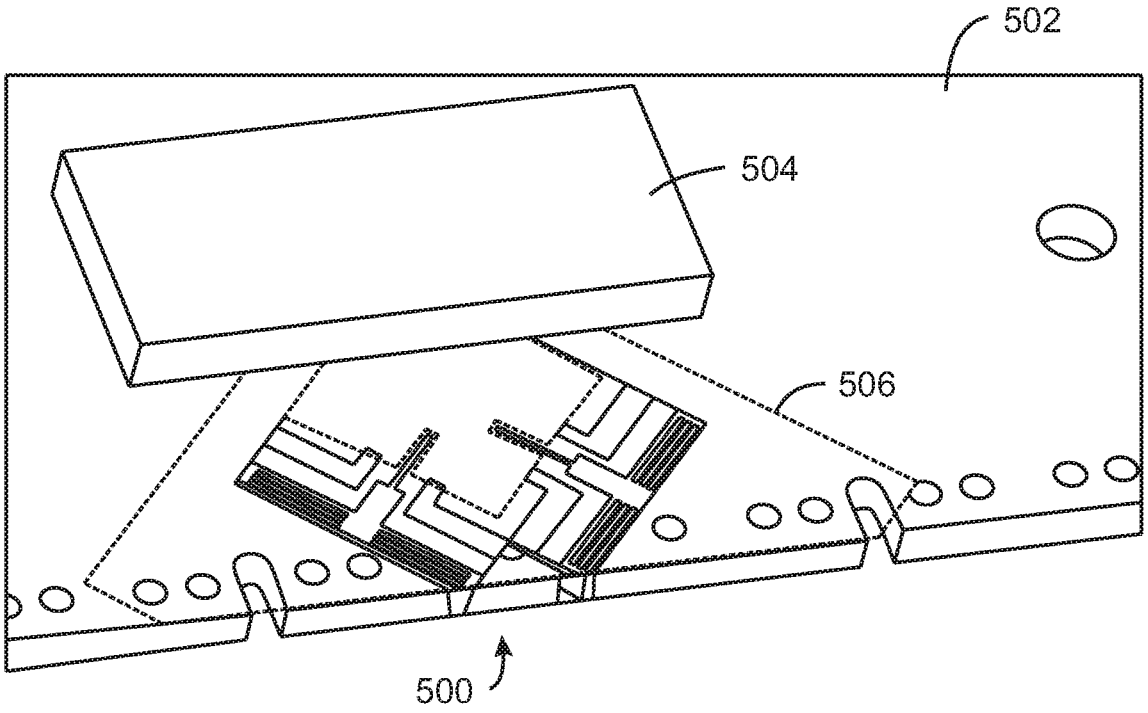
FIG. 6 is a partial view of a platform circuit board with an end-fire open slot antenna.

FIG. 6 is a partial view of a platform circuit board with an end-fire open slot antenna. The end-fire open slot antenna 500 is the V-shaped antenna shown in FIG. 5. The antenna 500 may be disposed at the edge of the device platforms main circuit board 502.

The circuit board 502 can also include with feedlines (not shown) coupling the V-shaped antenna to respective RF transmitter and receiver circuits. The transmitter and receiver circuits may be enclosed with an EM shield 504 along with various additional electronic components disposed on the circuit board 502. The EM shield 504 can be positioned to improve the effective gain of the antenna 500. The active area of each open slot antenna is designated as a "keep out" area, which is designated by the dashed box 506. Additional components may be included in the circuit substrate outside of the keep out area.

Figure 7:
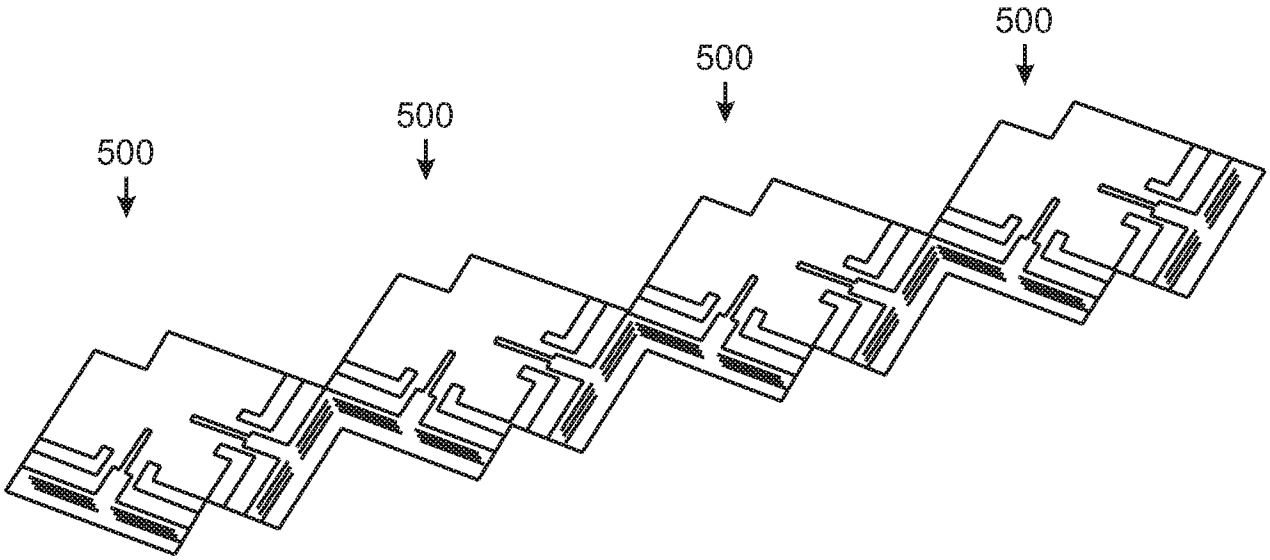
FIG. 7 is an array of an end-fire open slot antennas.

FIG. 7 is an array of an end-fire open slot antennas. Each antenna in the array may be one of the V-shaped antennas 500 shown in FIG. 5. In this example, the antennas 500 are assembled into an array of 1×4 antennas. However, other array sizes are also possible. The total directivity gain of the array may be around 10.5 dBi. The array has excellent end-fire radiation with good coverage over broadside up to 160 degrees (see FIGS. 8 and 9). This coverage may eliminate the need for separate broadside antennas in some applications, which will further reduce the size required by antennas in the electronic device. In some examples, the antenna 500 may be configurable as a Multiple-Input Multiple-Output (MIMO) antenna system. The antenna array 700 may be disposed at the edge of the device platforms main circuit board as shown in FIG. 6. The scanning coverage for 3 dB beam width in the azimuth plane may be as broad as +/−80 degrees from side to side relative to the end-fire direction.

Figure 8:
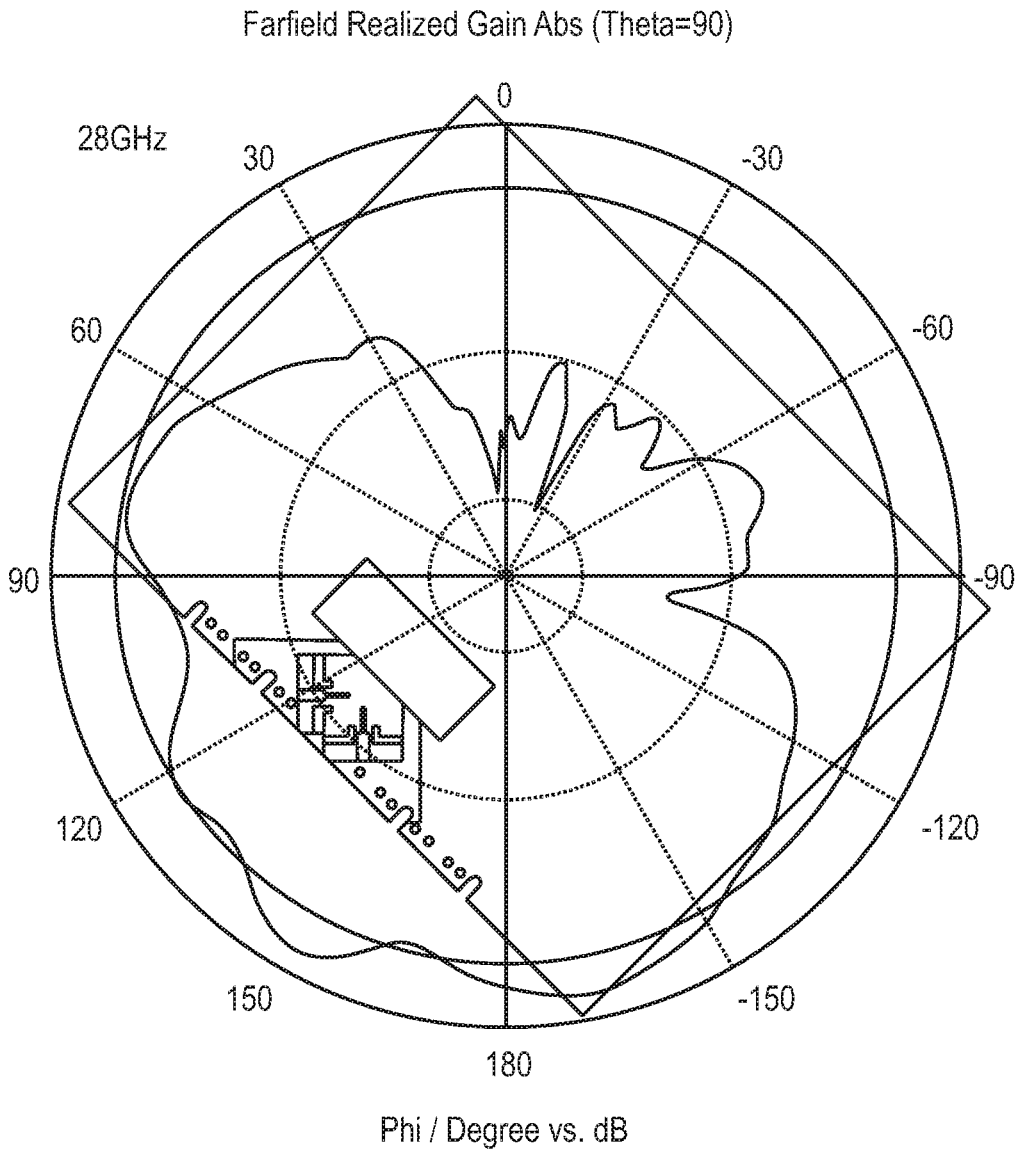
FIG. 8 is an example radiation pattern for the V-shaped antenna 500.

FIG. 8 is an example radiation pattern for the V-shaped antenna 500. The example radiation pattern is a simulated radiation patter, simulated at 28 GHz with a 10 layer stack-up RF package. The radiation pattern is superimposed over a top view of the V-shaped antenna 500. Although not shown, the radiation pattern will similar across the frequency band from 28 GHz to 39 GHz. The main lobe at 150 degrees exhibits a magnitude of 3.4 dB.

Figure 9:
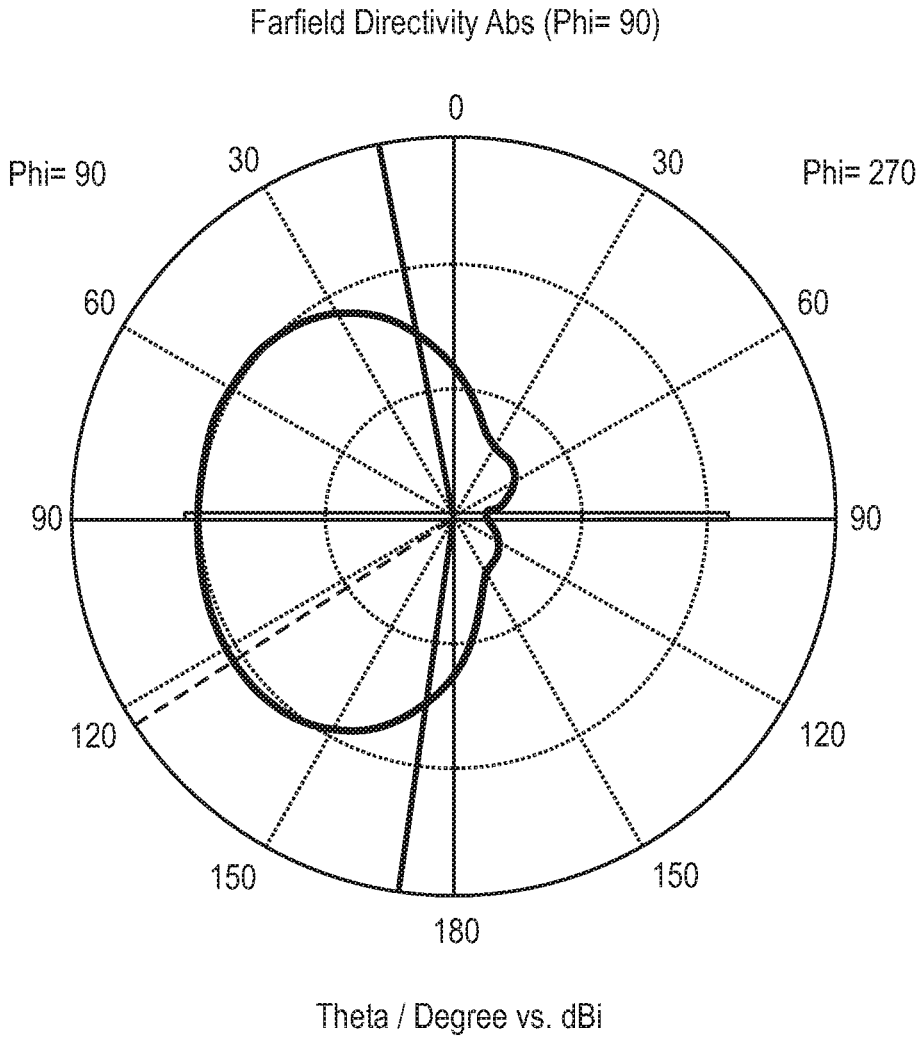
FIG. 9 is an example radiation pattern for the V-shaped antenna 500.

FIG. 9 is an example radiation pattern for the V-shaped antenna 500. The example radiation pattern is a simulated radiation pattern, simulated at 28 GHz with a 10 layer stack-up RF package. The radiation pattern is superimposed over a side view of the V-shaped antenna 500. Although not shown, the radiation pattern will similar across the frequency band from 28 GHz to 39 GHz. FIG. 9 demonstrates that the angle coverage for the V-shaped antenna 500 is close to 160 degrees over the broadside.

Figure 10A:
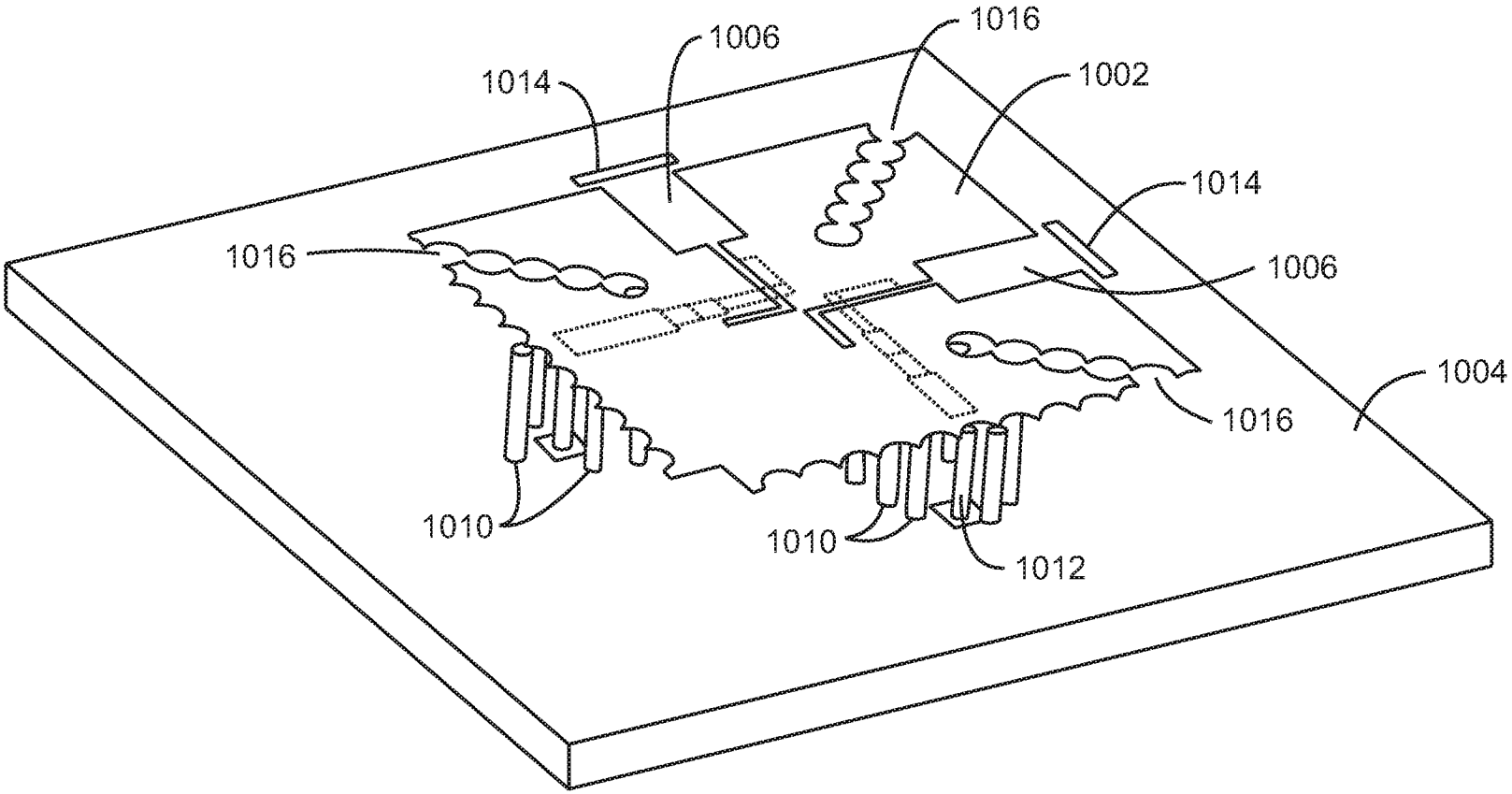
FIG. 10A is a perspective view of an example broadside open slot antenna.

FIG. 10A is a perspective view of an example broadside open slot antenna. The broadside open slot antenna 1000 is configured to radiate in the broadside direction, i.e. perpendicular to the plane of the antenna. Additionally, the antenna 1000 is configured to provide dual polarization. The antenna 1000 includes a conductive ground plane 1002 disposed over a reflector 1004. Instead of directing the radiation pattern to the end-fire direction, the radiation of the antenna is directed to the broadside by the reflector 1004. The antenna will also include one or more dielectric layers separating the ground layer 1002 and the reflector 1004. However, for the sake of clarity those layers are not shown.

The bandwidth of an antenna may be expressed as a percentage, sometimes referred to as "percent bandwidth" or "relative bandwidth." Percent bandwidth may be calculated as the absolute bandwidth divided by the center frequency. For example, an antenna with a 1 GHz bandwidth centered at 10 GHz will have a passband of 9.5 GHz to 10.5 GHz and a 10 percent bandwidth. Typical broadside antennas based on the stacked patch design generally have a small bandwidth, in some cases 3-5 percent. To achieve higher bandwidth (>40%), the embodiment here shows a design that is based on the open slot concept. The slot design is based on the end-fire slot antenna discussed earlier, in which it is an open slot excited by impedance stepped slot apertures. The dual polarization performance is achieved by 2 orthogonal collocating resonant slots.

In the example broadside slot antenna 1000, the ground plane 1002 includes two excitation apertures 1006 and resonant slots 1007 disposed orthogonal to one another on a top surface of a substrate layer. One of the slots provides a first polarization and the other slot provides a second polarization orthogonal to the first polarization. The separation distance between the reflector 1004 and the resonant slots of a quarter wavelength referencing the center frequency of the operation bandwidth allows the radiation to be reflected and added constructively in the normal direction, hence broadside radiation pattern achieved.

Each slot is fed by a microstrip signal line 1008, which is disposed on the opposite side the substrate layer. The reflector 1004 may be disposed at about a quarter wavelength (effective wavelength) from the ground layer 1002. The reflector 1004 may conductive coupled to the ground layer 1002 by conductive through vias 1010. Additionally, each of the microstrip feedlines 1008 may also be coupled to a through via 1012, which passes through a void in the reflector 1004.

In some examples, the microstrip feed lines and the excitation aperture of the resonant slots are folded to allow the two resonant slots to collocate in the smallest possible area. Additionally, the excitation aperture 1006 and the microstrip feed lines may have a stepped impedance structure to improve the bandwidth performance, to approximately 40 percent in some cases. Each resonant slot can also be associated with a parasitic strip 1014 located next to the slot to provide further impedance tuning for the high band.

In some examples, the ground plane 1002 includes circular cutouts 1016 on either side of each resonant slot 1007 to improve isolation between the resonant slots and thus the two polarizations. The cuts act as resonant chokes along the edges of the slots to isolate the excitation of one slot from the other slot.

Figure 10B:
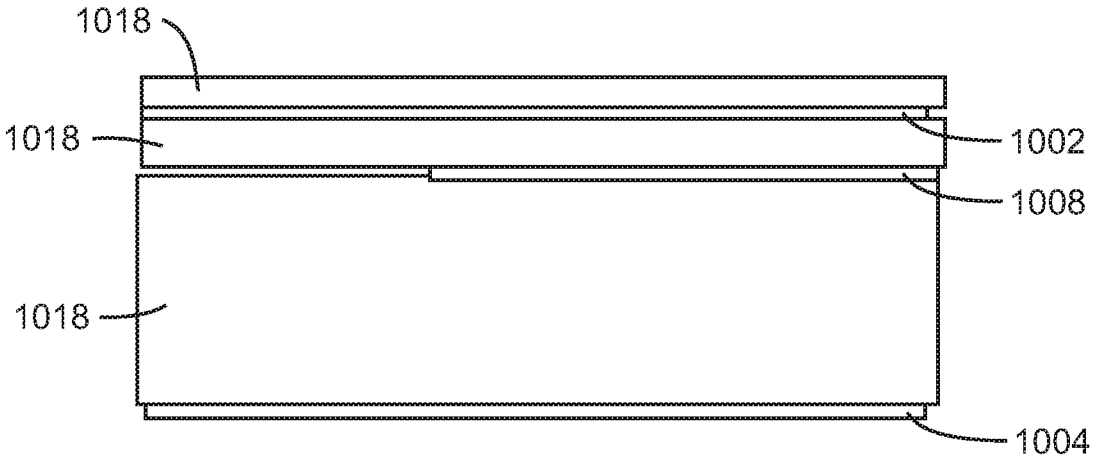
FIG. 10B is a side view of the example broadside open slot antenna shown in FIG. 10A.

FIG. 10B is a side view of the example broadside open slot antenna shown in FIG. 10A. In FIG. 10B, the top metal layer is the slotted ground plane 1002, the next metal layer includes the microstrip lines 1008, and the bottom layer is the reflector 1004. Also shown in FIG. 10B are the dielectric layers 1018 between the metal layers. To minimize the size of the resonant slots, the dielectric layers may be formed from substrates having a high permittivity value, for example, relative permittivity greater than 6. In some embodiments, there may be also be a layer of dielectric substrate 1018 placed above the ground layer 1002. This allows the slots to be further reduced in size by loading the resonant slots with higher dielectric material.

Each resonant slot will have approximately an omnidirectional radiation pattern similar to a dipole antenna. In this embodiment, the broadband broadside slot antenna 1000 may be configured to operate in a frequency range from 27 to 43 GHz with a size of 4 mm×4 mm×1 mm high, assuming dielectric substrate layers with relative permittivity of 6.

Figure 11:
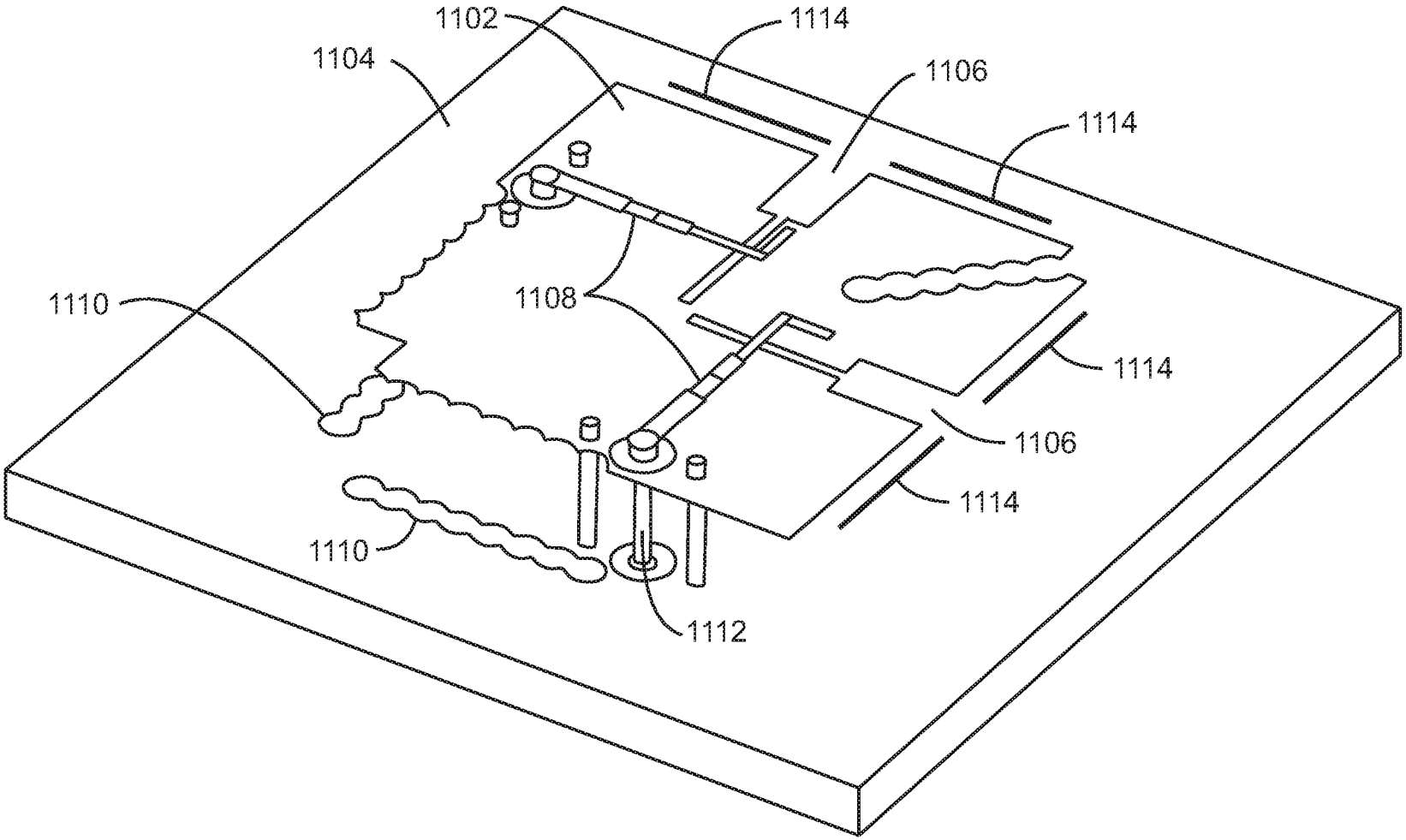
FIG. 11 is another example of a broadside open slot antenna.

FIG. 11 is another example of a broadside open slot antenna. The broadside open slot antenna 1100 is similar to the antenna 1000 shown in FIGS. 10A and 10B and includes a conductive ground plane 1102 disposed over a reflector 1104. The ground plane 1102 also includes orthogonal resonant slots 1106, each one fed by a microstrip feedline 1108. However, in this example, the microstrip feedlines 1108 are disposed above the excitation aperture 1106. It will be appreciated that the antenna 1100 will also include dielectric layers separating the ground layer 1102, the reflector 1104, and the feedlines 1108. In this example, the vias 1112 and 1113 are plated through vias to allow low cost and high yield in fabrication of multi-layer structures.

Another difference between the antenna 1100 and the antenna 1000 shown in FIGS. 10A and 10B is the additional circular cutouts 1110 in the reflector 1104. The circular cutouts 1110 are disposed on either side of the feedline vias 1112 and act as resonant chokes to improve isolation between the feedlines and thus the two polarizations.

Another difference between the antenna 1100 and the antenna 1000 shown in FIGS. 10A and 10B is the position of the parasitic directors 1114. The parasitic directors 1114 may be altered to effect changes in the radiation pattern.

Figure 12:
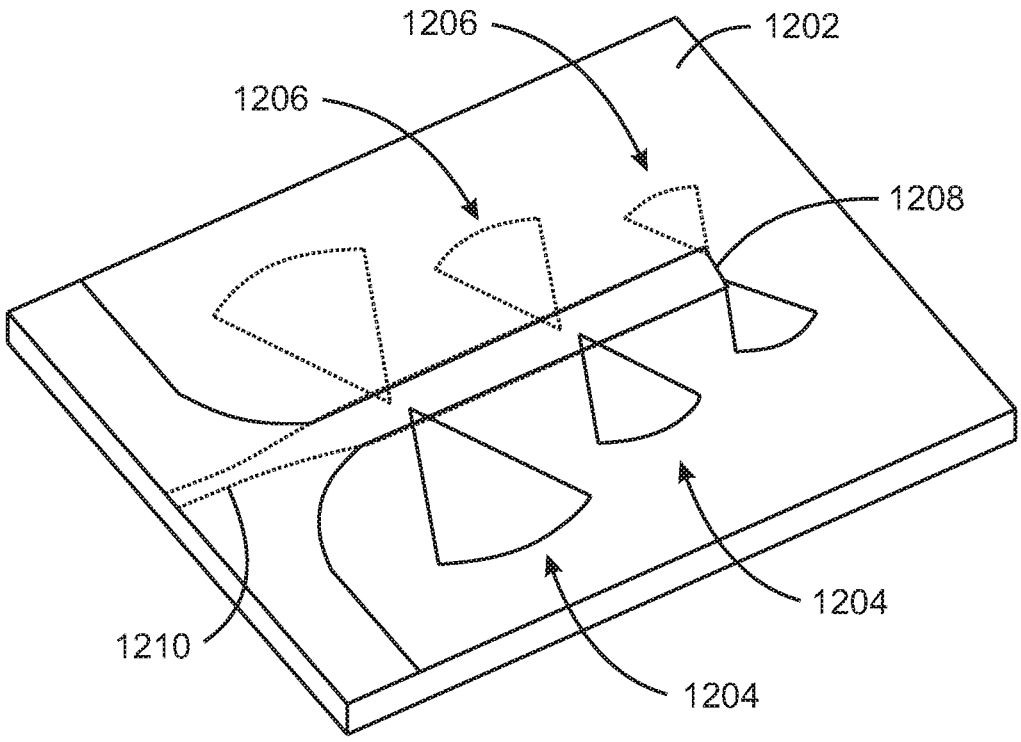
FIG. 12 is an example high directivity end-fire and broadside antenna.

FIG. 12 is an example high directivity end-fire and broadside antenna. The antenna 1200 is a periodic bowtie style antenna printed on a dielectric substrate 1202. The antenna 1200 includes three bowtie shaped dipoles 1204 printed on a first side of a dielectric substrate, and three bowtie shaped dipoles 1206 printed on the opposite side of the dielectric substrate. The two arms of each bowtie element are printed on different sides of the substrate. The bowtie elements are excited by a parallel strip line (PSL), which includes a stripline conductor 1208 on the first side of the dielectric substrate and coupled to the bowtie shaped dipoles printed on that side, and another stripline conductor 1210 on the second side of the dielectric substrate and coupled to the bowtie shaped dipoles printed on the second side. Those components printed on the second side, or bottom side, of the substrate are shown with dotted lines.

Bowtie antennas are variations of dipole antennas so they share similar operation principles. However, bowties shape allows the resonant modes on the two arms to expand to more neighbor modes therefore broadening the operation bandwidth. The bowtie elements are separated along the PSL by a tuning factor. Electrically, they simulate a series of three element yagi antennas connected together and each tuned to a different frequency band. Therefore the bowtie elements can provide both wide band (extra resonant modes supported by the bowtie shape and the multiple bands supported by multiple bowties) and high gain radiation characteristics (due to periodic spacing of the bowties acting as reflectors and directors to one another). In some implementations, the periodic spacing may not be strictly periodic according to a fixed ratio. The periodic spacing may be tuned to the according to the desired frequency bands, the bandwidth of each frequency band, and the separation of the frequency bands.

The parallel strip line may be matched to a standard impedance microstrip line via a tapering section. The signal line of the microstrip transmission line is tapered linearly to the signal line of the PSL. The ground portion of the microstrip transmission line is tapered with a tuning radius to the reference line of the PSL. This transition has small return loss and wide bandwidth to support the operating frequencies of the bowtie elements, and thus eliminates the requirement for a balun.

The example of the embodiment here has the dimensions of 4.5 mm×6.5 mm on an 80 um Bismaleimide-Triazine (BT) laminate. The antenna 1200 is a simple low cost antenna structure that provides end-fire and broadside radiation for mmWave frequency applications. The antenna 1200 provides wide bandwidth and high gain with low gain variation across the operational frequencies.

In some examples, the thin substrate (50-100 um) that can be embedded in stack-up of various layers (as thick as 800 um or more). Simple stackup in the case of the broadside slot antenna allows for low cost and high yield fabrication. The printed slot antenna has a small keep out area that allows other components to be buried in the stack-up. This can reduce the antenna count for embedded solutions and minimize size so more antenna array elements can be implemented given the same occupied area. When connecting with switches or diplexers, the operation frequency bands can be configured from the RFIC on a single RF package, which further reduces fabrication costs and hardware changes.

Figure 13:
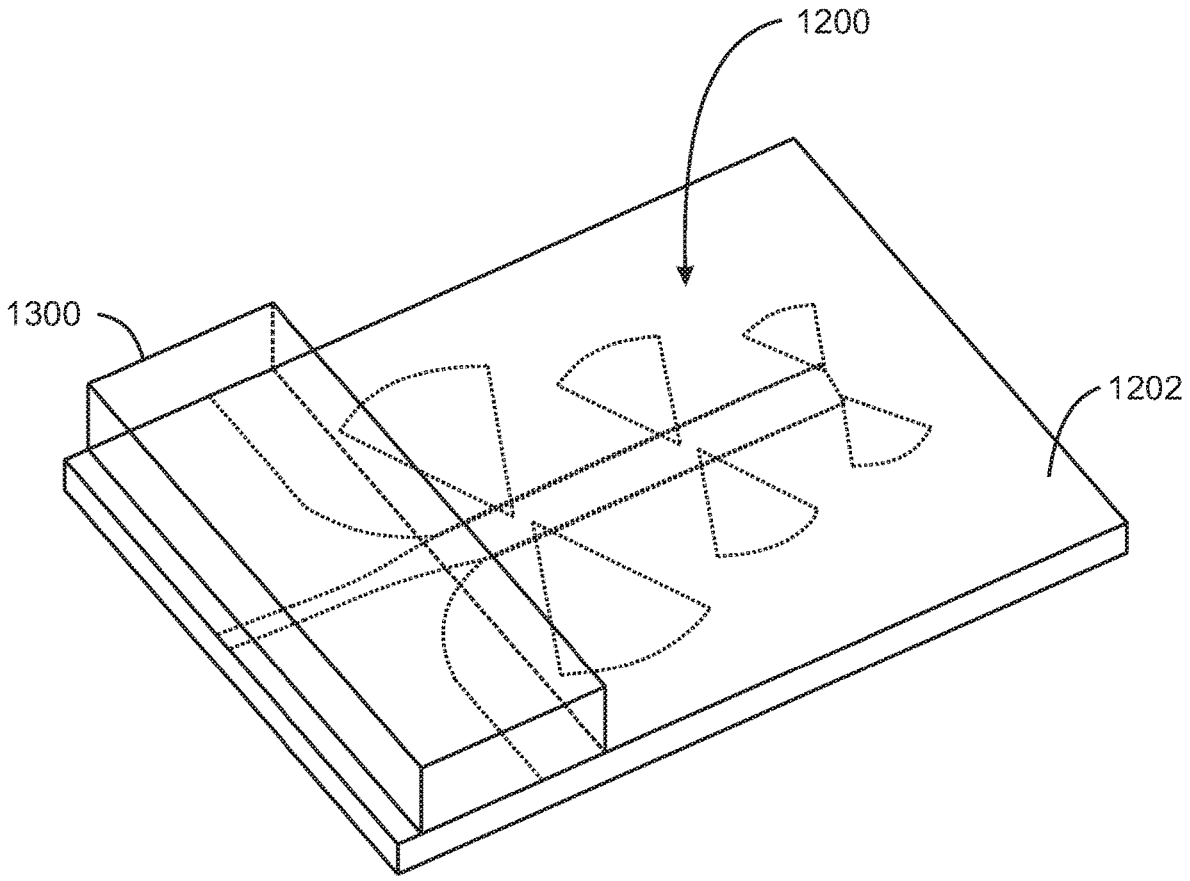
FIG. 13 is another view of the high directivity end-fire and broadside antenna shown in FIG. 12.

FIG. 13 is another view of the high directivity end-fire and broadside antenna shown in FIG. 12. In this embodiment, the antenna 1200 is shown with dotted lines to indicate that the antenna 1200 is covered by a dielectric material. However, the features of the antenna 1200 are the same as discussed in regard to FIG. 12. Also shown in FIG. 13 is an EM shield 1300. The EM shield 1300 various electronic components can be disposed inside EM shield 1300, including transmitter and receiver circuits and others. The EM shield is disposed outside of the keep out area of the antenna 1200.

Figure 14:
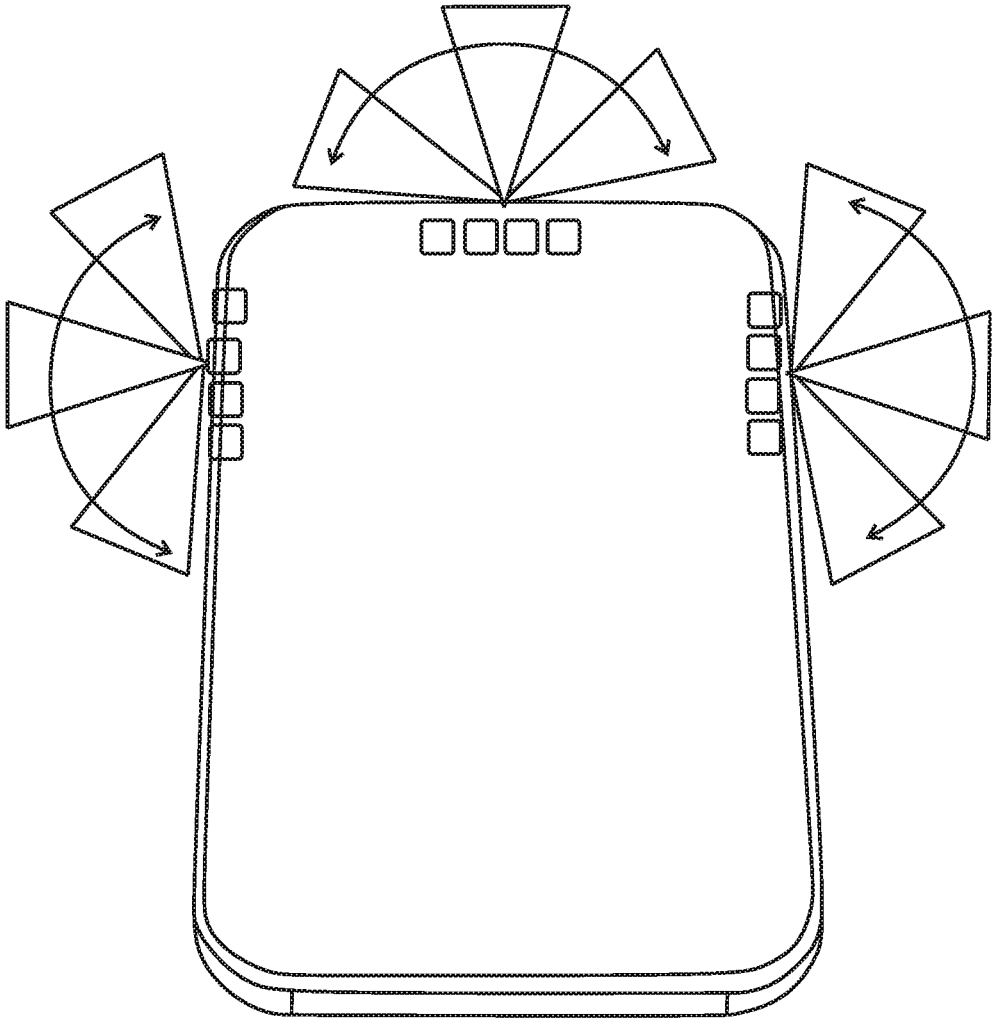
FIG. 14 is a perspective view of a mobile electronic device 1400.

FIG. 14 is a perspective view of a mobile electronic device 1400. The mobile device 1400 may be a smart phone, tablet computer, and the like. FIG. 14 also shows an antenna system that may be implemented in the mobile electronic device 1400. In the example shown in FIG. 14, the mobile electronic device 1400 includes three sets of antennas, with each set including four antennas each. Each set of antennas can be configured as a separate array or combined in a single array, among other configurations. The scanning angle for each set of antennas may be approximately 160 degrees.

The antennas may be include any suitable number and type of antennas described herein, including the end-fire open slot antennas, V-shaped slot antennas, broadside slot antennas, parabolic bowties, and combinations thereof. The antenna system shown in FIG. 14 provides coverage for a 270 degree angle around the device 1400 relative to the end-fire direction. Also, depending on the antenna type, the antenna system can also provide coverage for a 180 degree angle around the device 1400 relative to the broadside direction.

The spatial coverage of the end-fire dual-band antennas can significantly minimize the used area in a mobile device. In an example embodiment, the mobile device can include arrays of dual band, dual polarization, end-fire V-shape slot antennas. This can reduce the antenna count to 4 while achieving the same operation frequencies and similar spatial coverage as a 16 antenna device.

Figure 15:
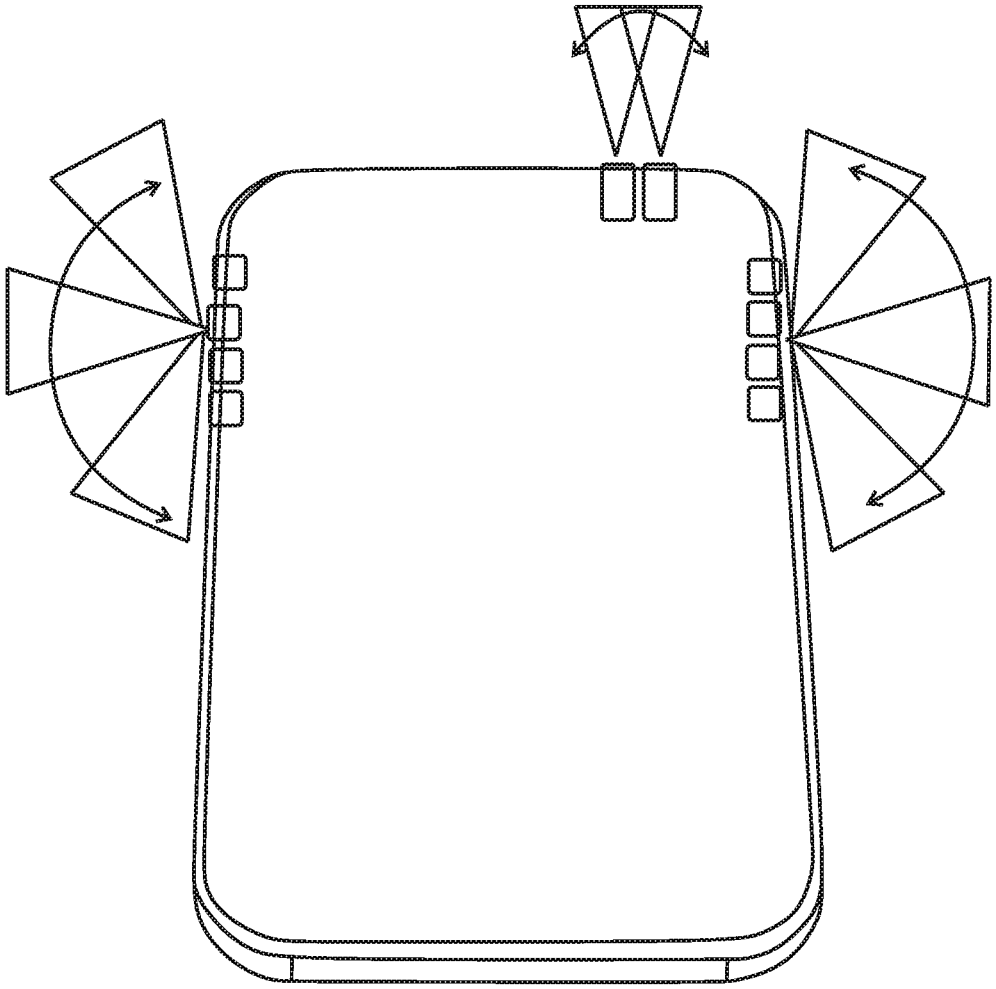
FIG. 15 is a perspective view of another mobile electronic device 1400.

FIG. 15 is a perspective view of another mobile electronic device 1400. FIG. 15 also shows another example antenna system that may be implemented in the mobile electronic device 1400. In the example shown in FIG. 15, the mobile electronic device 1500 includes three sets of antennas, with the sets on the side of the device 1500 including four antennas each, and the sets at the top edge of the device 1500 having two high directivity antennas.

In an example embodiment, the antennas on the sides of the device 1500 are V-shaped open slot antennas, and the antennas on the top edge of the device 1500 are periodic bowtie antennas. Each antenna has a broad bandwidth that enables it operate across all frequencies of interest. Thus, the antennas can be combined in a single array.

Figure 16:
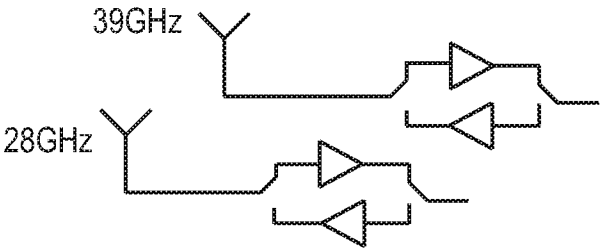
FIG. 16 is an example switching network that may be used in an antenna system.

FIG. 16 is an example switching network that may be used in an antenna system. This switch arrangement can be used when the antenna system includes two different antennas to cover different frequency bands, one to cover the 28 GHz band and one to cover the 39 GHz bands. In this example, the antennas can be connected directly to the transmit/receive paths and limit additional loss caused by switches.

Figure 17:
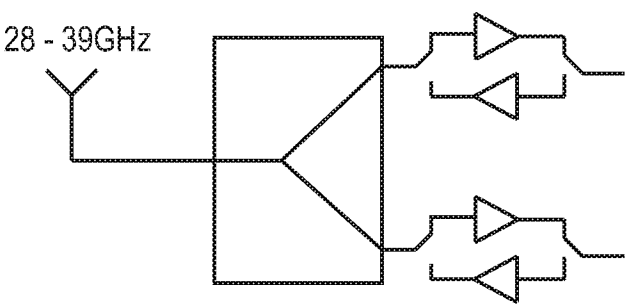
FIG. 17 is another example switching network that may be used in an antenna system

FIG. 17 is another example switching network that may be used in an antenna system. This switch arrangement can be used when the antenna system includes a single dual band antenna that is able to cover the 28 GHz band and the 39 GHz band. In this embodiment, the dual band antenna can be coupled to the transmit/receive paths with a diplexer. This reduces the insertion loss in the RF path to 1 dB or less. In a low pass/high pass diplexer, the insertion loss can be reduced to 0.4 dB-0.6 dB with loss depending on the bands to be isolated from each other.

Figure 18A:
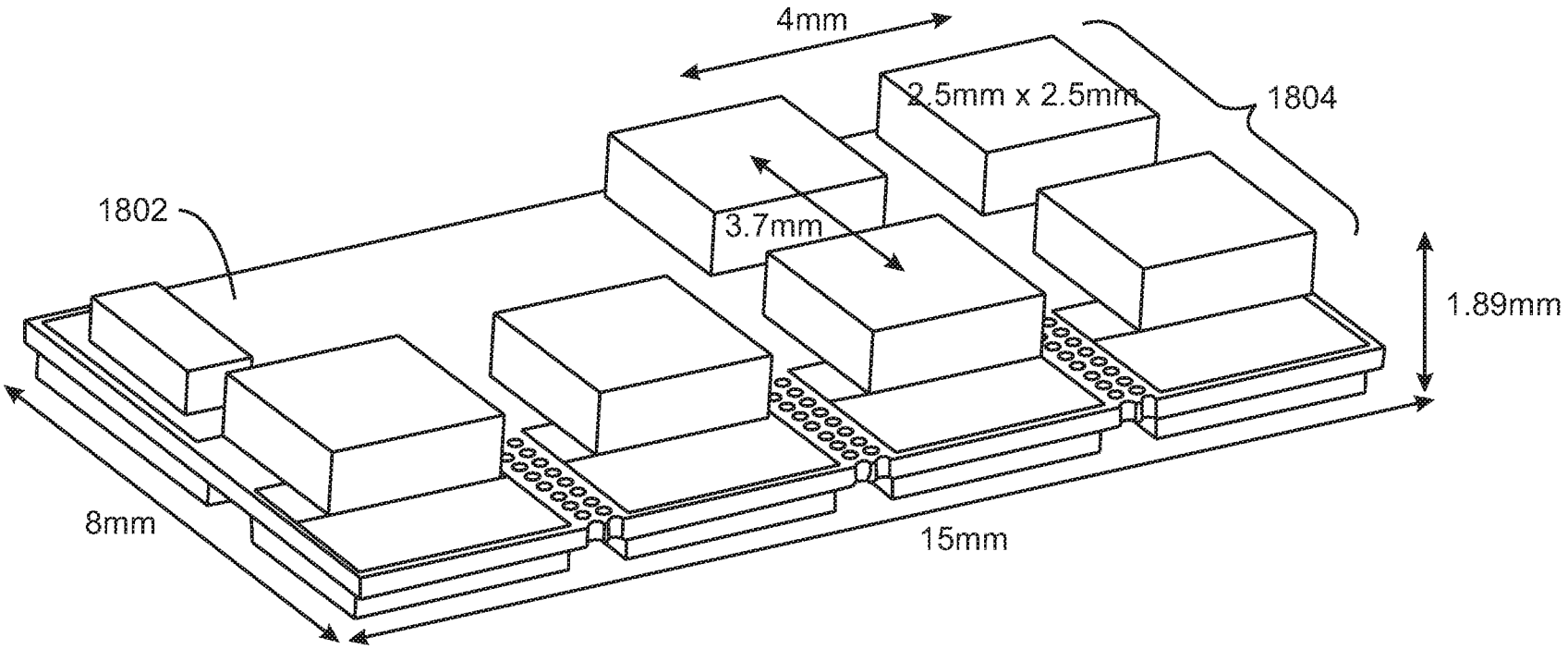
FIG. 18A is a perspective view of an RF module that integrates broadside and end-fire antenna arrays on both sides of the package substrate.

FIG. 18A is a perspective view of an RF module that integrates broadside and end-fire antenna arrays on both sides of the package substrate. The RF module 1800 may be used in 5G and mmWave applications. The RF module includes a package substrate, which in some embodiments may be made of 8 layers of 0.3 mm thick dielectric with relative permittivity of 3.5. One side of the RF module includes an array of broadside antennas. The broadside antennas may be the broadside open slot antennas described above in relation to FIGS. 9-11 or other type of broadside antenna. In this example, the broadside antennas are positioned to be able to form a 1×4 broadside antenna array or 2×2 broadside antenna array (4 antennas turned on at a time). Other positional arrangements are also possible.

Figure 18B:
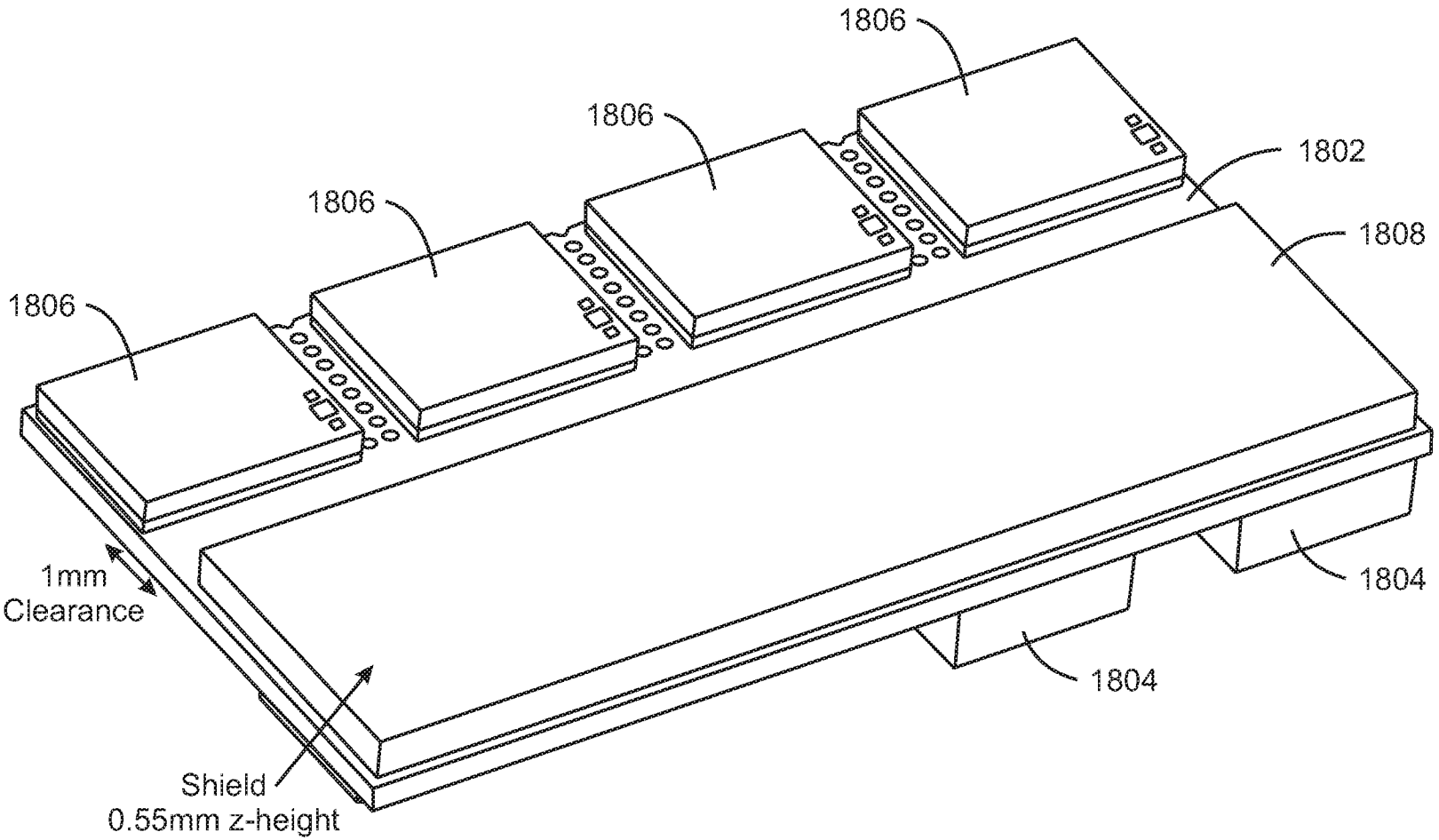
FIG. 18B is a perspective view showing the other side of RF module shown in FIG. 18A.

FIG. 18B is a perspective view showing the other side of RF module shown in FIG. 18A. The other side of the RF module 1800 includes an array of end-fire antennas 1806. The end-fire antennas 1806 may be any of the end-fire antennas described above including the open slot antennas, V-shaped open slot antennas, and others. In this example, the end-fire antennas 1806 are positioned at the edge of the package substrate to be able to form a 1×4 end-fire antenna array. Additionally, the end-fire antennas are positioned next to the EM shield, which may be used to shield the computer chips and other electric components from the radiation generated by the antennas. Other positional arrangements are also possible. In this example of platform integration, the drill holes 1809 improve decoupling between elements in the end-fire array.

Figure 19A:
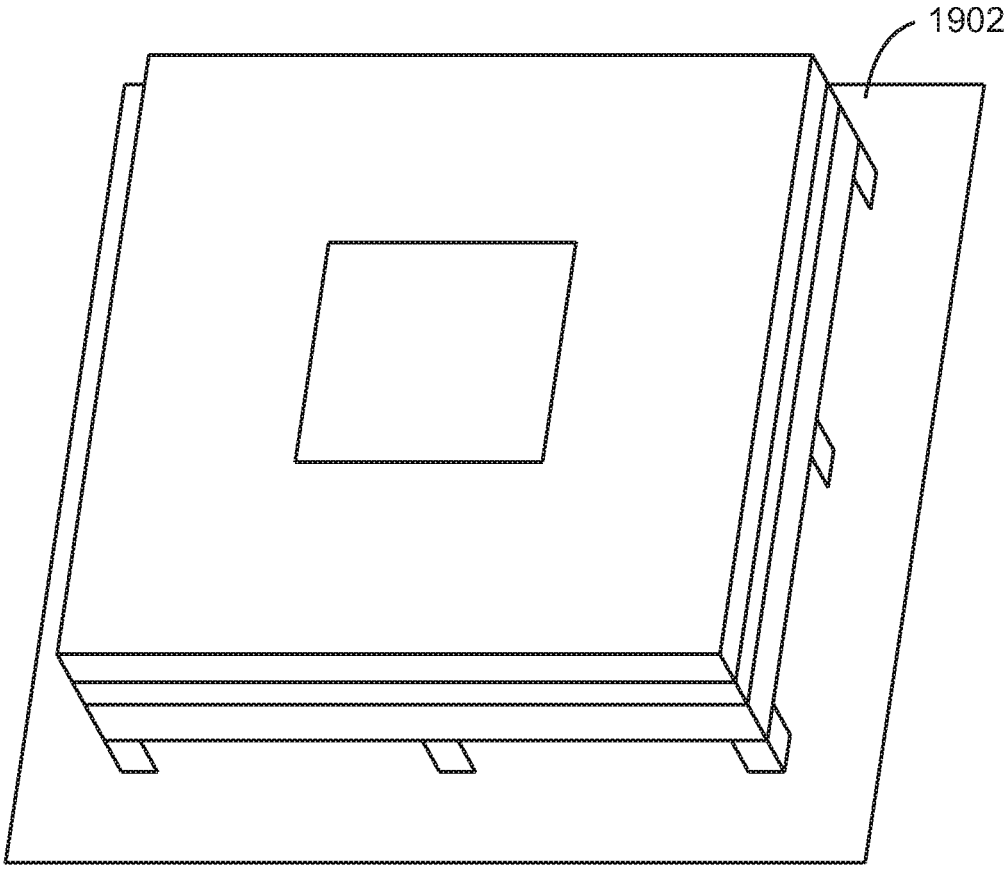
FIG. 19A is a perspective view of an example of a dual-band dual-polarized triple stacked patch antenna.

FIG. 19A is a perspective view of an example of a dual-band dual-polarized triple stacked patch antenna. The triple stacked patch antenna 1900 can provide broadside coverage for pico/femto cells and mobile applications. The antenna 1900 includes three parasitic patches that are stacked over each other, of which one patch exhibits a rectangular cutout (see FIGS. 19B and 19C). The antenna itself is exited via an aperture in the ground-plane (see FIGS. 19B, 19C, and 19E). The excitation of the aperture is based on a more complex feeding-network that can be seen in FIG.

19E. The aperture (which is symmetrically excited) enables the coupling of power from the feeding network to the patches. Depending on which band is driven, either the patch in the middle (low-band) or the other two patches (high-band) will get into resonance. The rectangular aperture of the patch in the middle enables power to couple from the lower patch to the upper one.

Figure 19B:
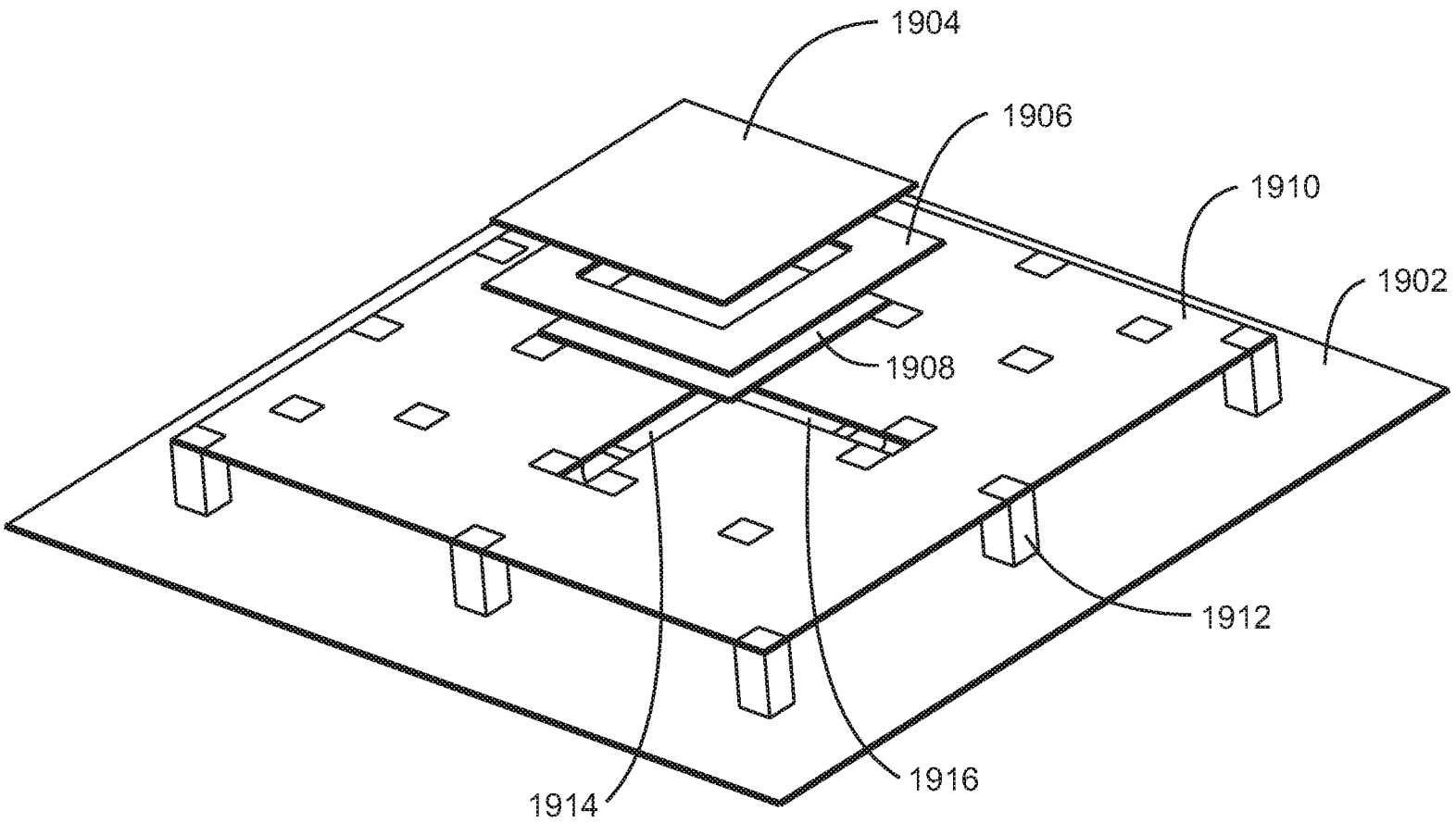
FIG. 19B is a perspective view the dual-band dual-polarized triple stacked patch antenna with the dielectric substrate layers removed.

FIG. 19B is a perspective view the dual-band dual-polarized triple stacked patch antenna with the dielectric substrate layers removed. FIG. 19B provides a view of the three patches 1904, 1906, and 1908. The rectangular cutout is included in the middle patch 1906. The patches are disposed over a ground layer 1910, which includes the excitation apertures 1914 and 1916. The excitation aperture 1914 is for generating a first polarization, and the excitation aperture 1916 for generating a second polarization orthogonal to the first polarization. Ground vias 1912 connect the excitation slotted ground layer 1910 to a second ground layer 1902. Together the two ground layers 1910 and 1902 support the signal stripline routing which is disposed in between them.

Figure 19C:
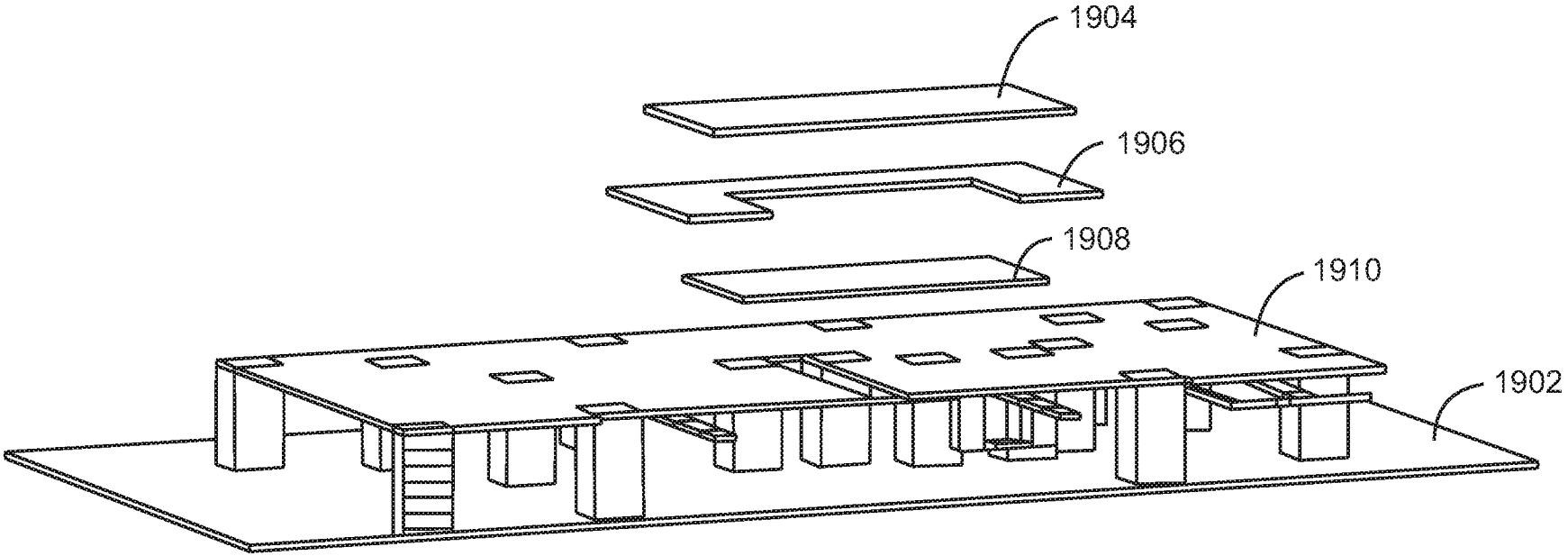
FIG. 19C is a cut-away view of the dual-band dual-polarized triple stacked patch antenna with the dielectric layers removed.

FIG. 19C is a cut-away view of the dual-band dual-polarized triple stacked patch antenna with the dielectric layers removed.

Figure 19D:
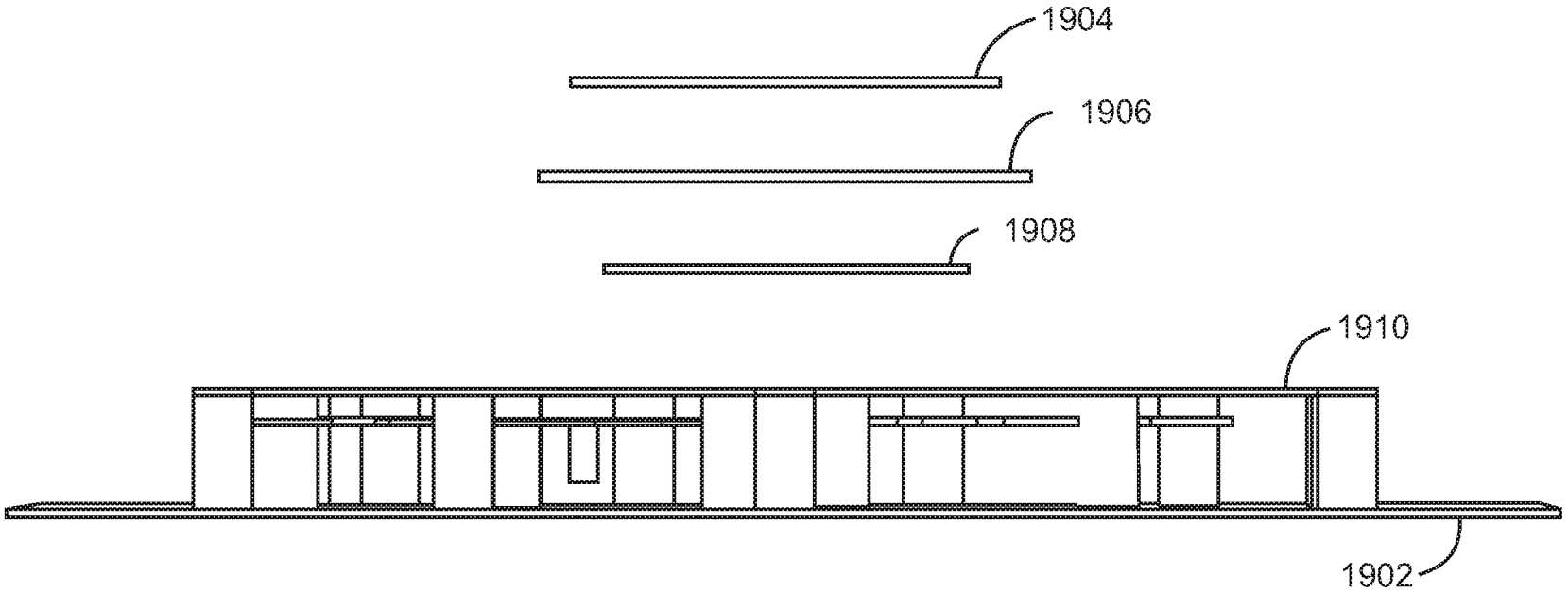
FIG. 19D is a side view the dual-band dual-polarized triple stacked patch antenna with the dielectric layers removed.

FIG. 19D is a side view the dual-band dual-polarized triple stacked patch antenna with the dielectric layers removed.

Figure 19E:
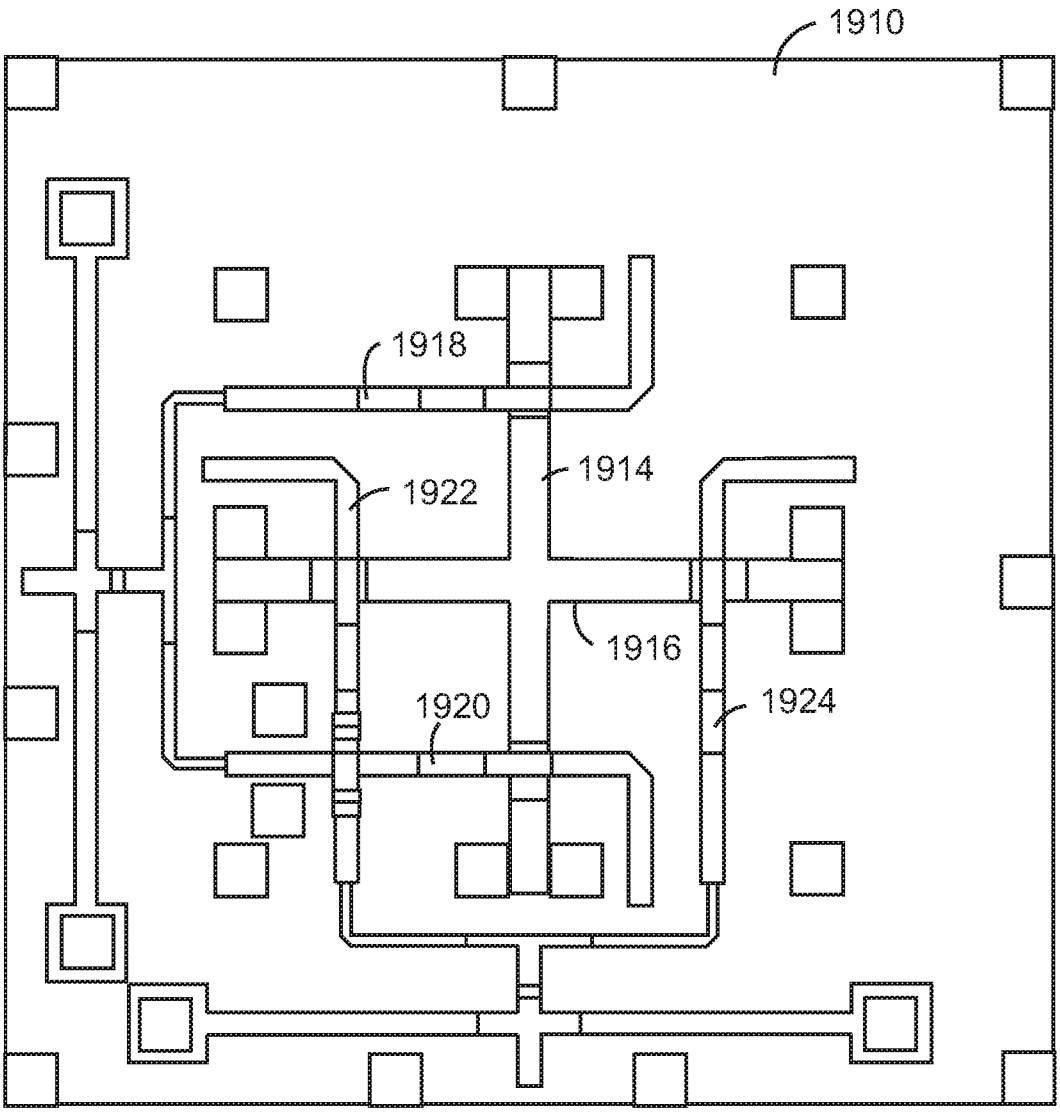
FIG. 19E is a top view of the dual-band dual-polarized triple stacked patch antenna showing the signal feeding network.

FIG. 19E is a top view of the dual-band dual-polarized triple stacked patch antenna showing the signal feeding network. The signal feeding network is a power divider network that splits power from a single port to two excitation striplines for each polarization. Striplines 1918 and 1920 are stepped impedance striplines for feeding the first polarization and provide excitation and stub matching for the excitation slot 1914. Striplines 1922 and 1924 are stepped impedance striplines for feeding the second polarization and provide excitation and stub matching for the excitation slot 1916. To collocate with the stripline 1920, the stripline 1922 is routed to another layer like a bridge as it crosses the stripline 1920.

Figure 20:
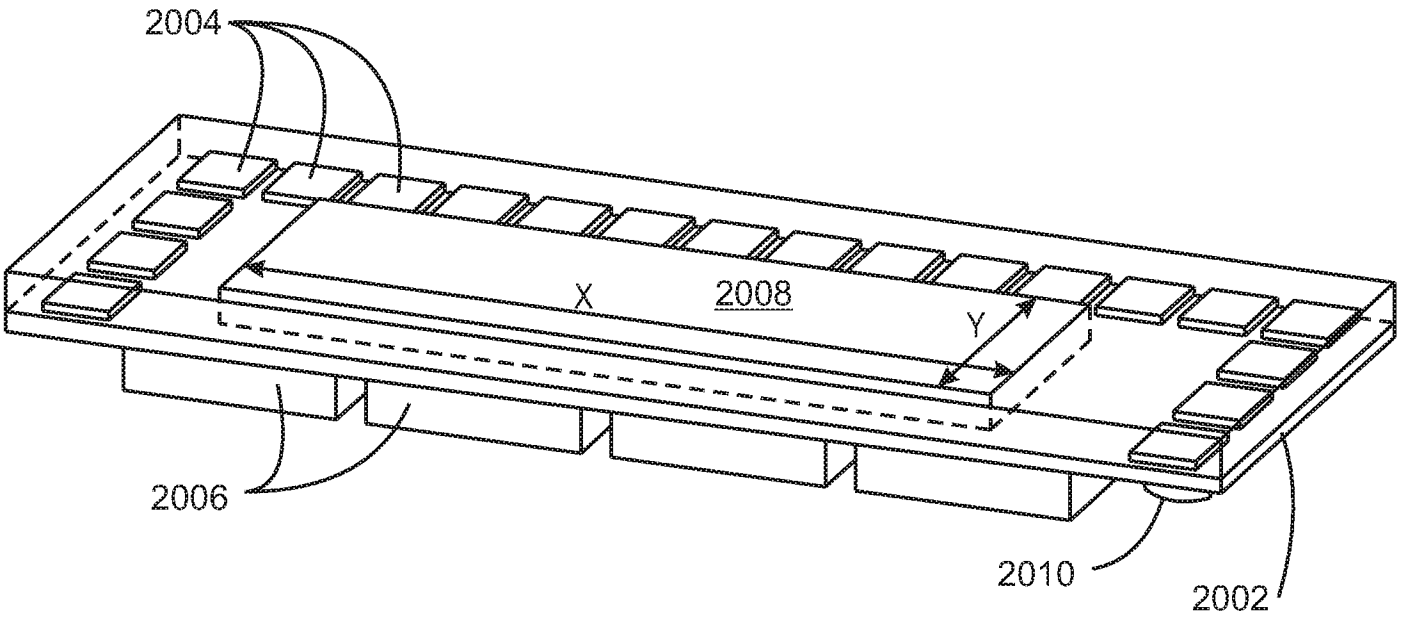
FIG. 20 is a perspective view of an example RF module that integrates antenna arrays on both sides of the package substrate and includes a selective shielding region.

FIG. 20 is a perspective view of an example RF module that integrates antenna arrays on both sides of the package substrate and includes a selective shielding region and, optionally, selective heat slugs within shielded area. As shown in FIG. 20, the RF module 2000 includes a circuit board 2002, a first array of antennas 2004 mounted on top side of the circuit board, and a second array of antennas 2006 mounted on a bottom side of the circuit board. In some embodiments, the antennas on the top side of the circuit board may be 60 GHz or 5G mmWave antennas with broadside and edge fire radiation patterns, such as the antennas shown in FIGS. 12 and 13. The antennas on the bottom side of the circuit board may be end-fire surface mount antennas such as the antenna shown in FIGS. 3A, 3B, and 3C or broadside antennas. Other arrangements are also possible.

The top side of the circuit board includes a shielded region 2008 that encloses various components used to operate the RF module, such as RF transmitter and receiver circuits, controllers, and the like. The shielded region is shielded to provide Electromagnetic Interference (EMI) protection for the antenna control circuitry enclosed within the shield. Shielding is achieved using a mechanical shield or using sputtered metallic materials. The circuit board includes interconnects that couple the antennas to the RF circuitry included in the shielded region. The bottom surface of the circuit board also includes one or more connectors 2010 to couple the RF module 2000 to an electronic device that can use the wireless communication capabilities offered by the RF module, including wireless routers, smart phones, laptop computers, and others. In some embodiments, the RF module does not include any external solder connections, and all of the power supply and control signals for controlling the RF module pass through the connectors. In some embodiments, the length of the shielded region in the X direction may be approximately 20 mm, and the length of the shielded region in the Y direction may be approximately 5 to 7 mm. The shielded region is described further in relation to FIG. 21. In these sections, the area occupied by the shielded region may depend on the design considerations of a particular embodiment and can optionally occupy the entire size of the RF module.

In some embodiments, the shielded region area may include a thermally conductive overmold which can extend to extents of top surface. It could also contain heat slugs over hot dies that emit excessive heat. The heat slugs may occupy the entire area of XY or may be small compared to XY, for example, covering each die individually. The heat slugs may be exposed to top surface and sides of modules. The heat slugs may be formed by any suitable materials, including metal, dummy silicon, or others. The contact to each RFIC die may be made using epoxy or thermally conductive material.

Figure 21:
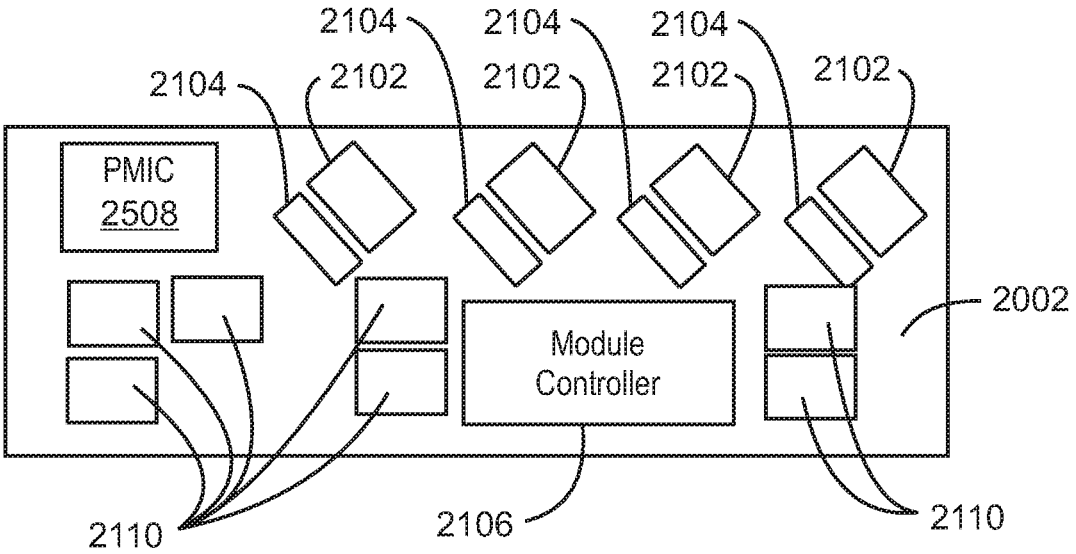
FIG. 21 is a top view showing the components in the selective shielding region of FIG. 20.

FIG. 21 is a top view showing the components in the selective shielding region of FIG. 20. The shielded region 2008 may include various components used to operate the RF module 2000. It will be appreciated that the components shown and their layout is provided by way of example and that various modifications may be made according to the design of a particular implementation.

The example RF module 2000 includes four high power RF integrated circuit (RFIC) dies 2102, which generate the RF signals to be transmitted and process the RF signals received from the antennas 2004 and 2006. Each RFIC die 2102 can include amplifiers, receivers, matching networks, filters, switches, and the like. Each die includes a separate controller die 2104 for controlling the operations of the individual die. Each of the controller dies 2104 maybe stacked on top of the corresponding RFIC die 2102 using Through-Silicon Vias (TSVs) between them or wirebonds communicatively coupling the controller die 2104 to the RFIC die 2102, either directly or through the circuit board 2002. The output of each die may be coupled to a pair of corresponding antennas located on the opposite side of the circuit board 2002. In the example shown in FIG. 21, each die is rotated to improve the placement of the dies with respect to the corresponding antennas by reducing the lengths of the interconnects between each die and its respective antennas.

The example RF module 2000 also includes a module controller 2106 that controls the global functioning of the RF module 2000 and the operations of all of the RFIC dies 2102. The RF module may also include a Power Management Integrated Circuit (PMIC) 2108 for controlling the power into and out of the RF module 2000. The PMIC 2108 may provide functions such as voltage scaling, power source selection, DC to DC conversion, and others. Other areas of the circuit board 2002, shown as boxes 2110, may include a variety of additional circuit components used for proper functioning of the RF module, such as inductors, capacitors, resistors, and the like.

The heat density of the RF module 2000 will tend to be greater at the RFIC dies 2102. For example, each RFIC die 2102 may dissipate as much as 0.7 to 0.9 Watts of power during operation. FIGS. 22-33 describe various techniques for providing an RF module that successfully dissipates the heat generated by the RF module while maintaining a small form factor.

Figure 22:
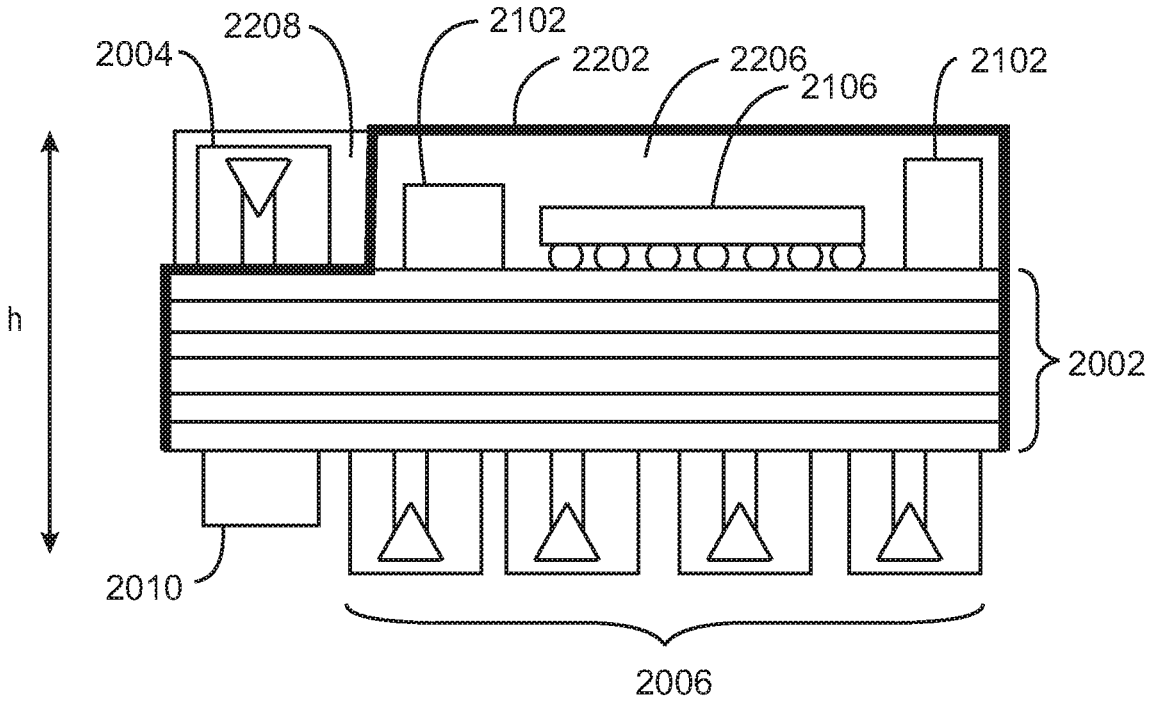
FIGS. 22-31 are diagrams of example layouts of an RF module.

FIG. 22 is a diagram of an example layout of an RF module. The RF module 2200 of FIG. 22 includes a multiple layer circuit board 2002, which may include 8 layers. The bottom surface of the circuit board 2002 includes the connectors 2010 and a set of antennas 2006, which may be 5G antennas configured as one or more arrays. For example, the bottom side antennas may be configured as one 1×4 dual broadside array and one 1×4 dual edge fire array or a single 2×4 dual broadside array. Other arrangements are also possible.

The top surface of the circuit board 2002 includes the module controller 2106, the RFIC dies 2102, and other circuit components referred to in relation to FIG. 21. The top surface of the circuit board 2002 also includes additional antennas 2004 as well as the shielded region 2008. As shown in FIG. 22, the shielded region 2008 is shielded by a conformal shield 2202 that extends over the module controller 2106, the RFIC dies 2102, and other circuit components, and extends under the top side antennas 2004. The conformal shield 2202 also extends along the sides of the circuit board 2002 to provide shielding for the interconnections disposed in the circuit board 2002. The top side of the circuit board 2002 also includes an overmold 2206, such as an epoxy overmold, which may be deposited using injection molding. The overmold material can be any type of material with a low electrical conductivity and high thermal conductivity. For example, the thermal conductivity, k, of the overmold material may be approximately 1 to 5 watts per meter-kelvin. The portion of shield 2202 extending through the overmold 2296 on the top side next to antenna 2004 may be achieved using a mechanical frame piece soldered and then exposed to top surface of mold using controlled laser drilling.

The conformal shield 2202 may be sprayed over the top and side surfaces of the RF module 2200 after the overmold 2206 is deposited and before the top side antennas 2004 have been coupled to or formed on the circuit board 2002. The conformal shield 2202 may be any suitable conductive material including copper, aluminum, conductive polymers, and others. The top-side antennas 2004 may then be coupled to the top of the circuit board 2002 and an additional overmold 2208 deposited over the top-side antennas 2004. The overmold 2206 and 2208 provides mechanical stability and electrical isolation to the top side antennas 2004 and other top side circuit components, while also enabling heat to dissipate from the RFIC dies 2102. The overmold also provides a support surface for application of the conformal shield 2202.

In some embodiments, the overall height, h, of the RF module 2200 may be approximately 2.0 mm. However, it will be appreciated that the height of the RF module 2200 may be reduced depending on the design of a particular implementation.

Figure 23:
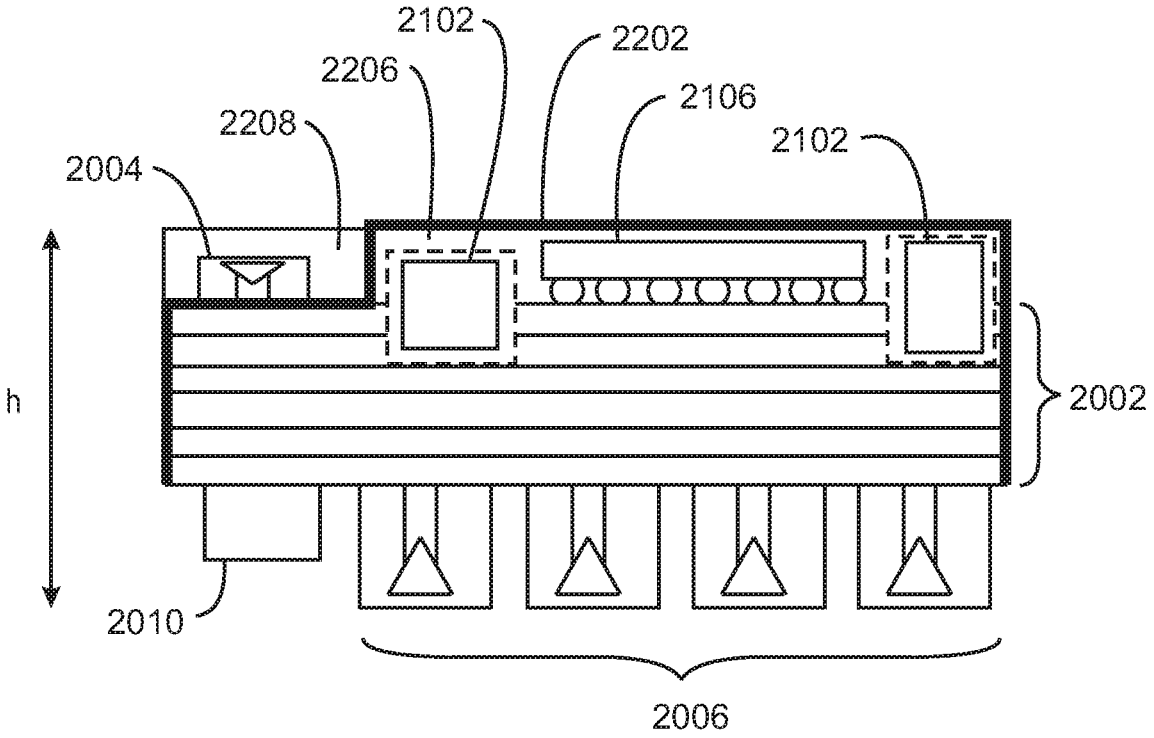

FIG. 23 is a diagram of another example layout of an RF module. The RF module 2300 of FIG. 23 is similar to the RF module 2200 of FIG. 22 and includes the multiple layer circuit board 2002, the connectors 2010 and antennas 2006 on the bottom surface of the circuit board 2002, and the module controller 2106, the RFIC dies 2102, overmold 2206 2208, and the conformal shield 2202 on the top side of the circuit board 2002.

To further reduce the height of the RF module 2300, the RFIC dies 2102 may be disposed in a recess of the circuit board 2002. The recesses may be formed by any suitable technique, including laser trimming. The depth of the recesses may be approximately 0.2 to 0.4 millimeters depending on the number of layers in the circuit board to be removed. Disposing the RFIC dies within a recess in the circuit board enables the overall height of the RF module 2300 to be reduced. As shown in FIG. 23, the overall height of the RF module 2300 may be approximately 1.6 to 1.8 mm. However, it will be appreciated that the specific dimensions shown are provided as examples and that other dimensions are also possible. The antennas 2004 on the top side of the circuit board 2002 may be printed surface mount antennas, which have a reduced height compared to the antennas shown in FIG. 22.

Figure 24:
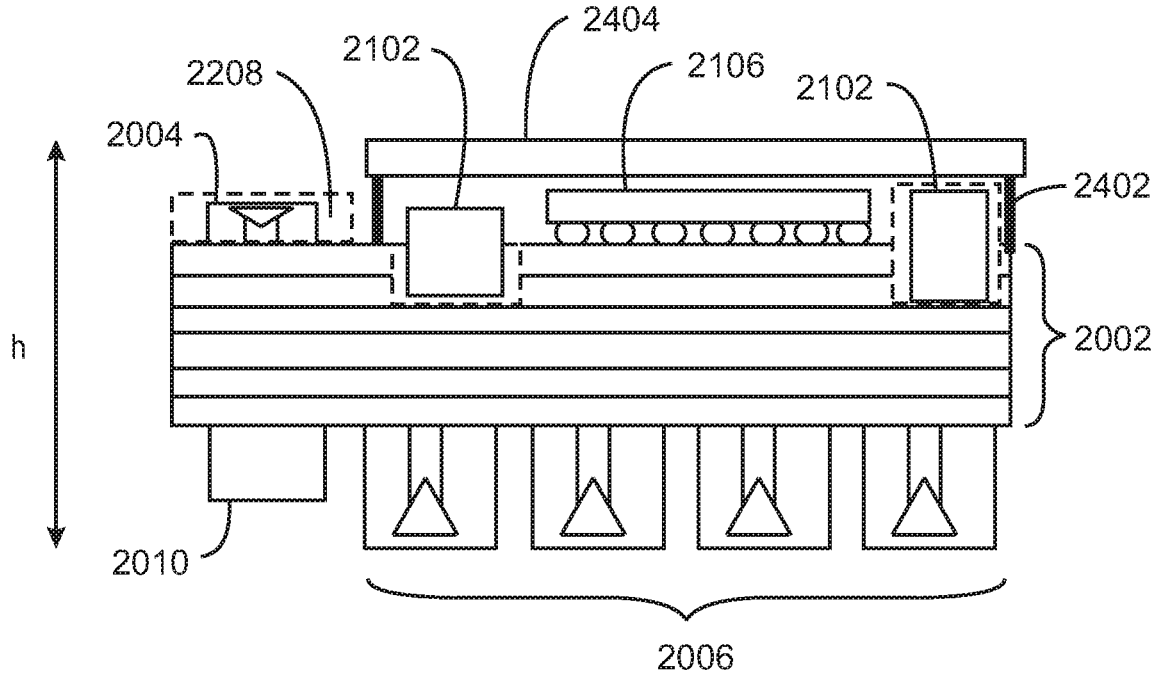

FIG. 24 is a diagram of another example layout of an RF module. The RF module 2400 of FIG. 24 is similar to the RF module 2300 of FIG. 23 and includes the multiple layer circuit board 2002, the connectors 2010 and antennas 2006 on the bottom surface of the circuit board 2002 and includes the module controller 2106 and the RFIC dies 2102 on the top side of the circuit board 2002. However, rather than an overmold and a conformal shield, the shielded region of the RF module 2400 is formed by a thermally conductive mechanical shield, which includes side walls 2402 and a lid 2404. The mechanical shield may be formed by fixing the walls 2402 of the shield to the circuit board and fixing the metal lid 2404 over the top of the walls, using the solder or conductive adhesives. The small air gap between mechanical shield and the RFIC dies 2102 can be filled with thermally conductive materials.

Figure 25:
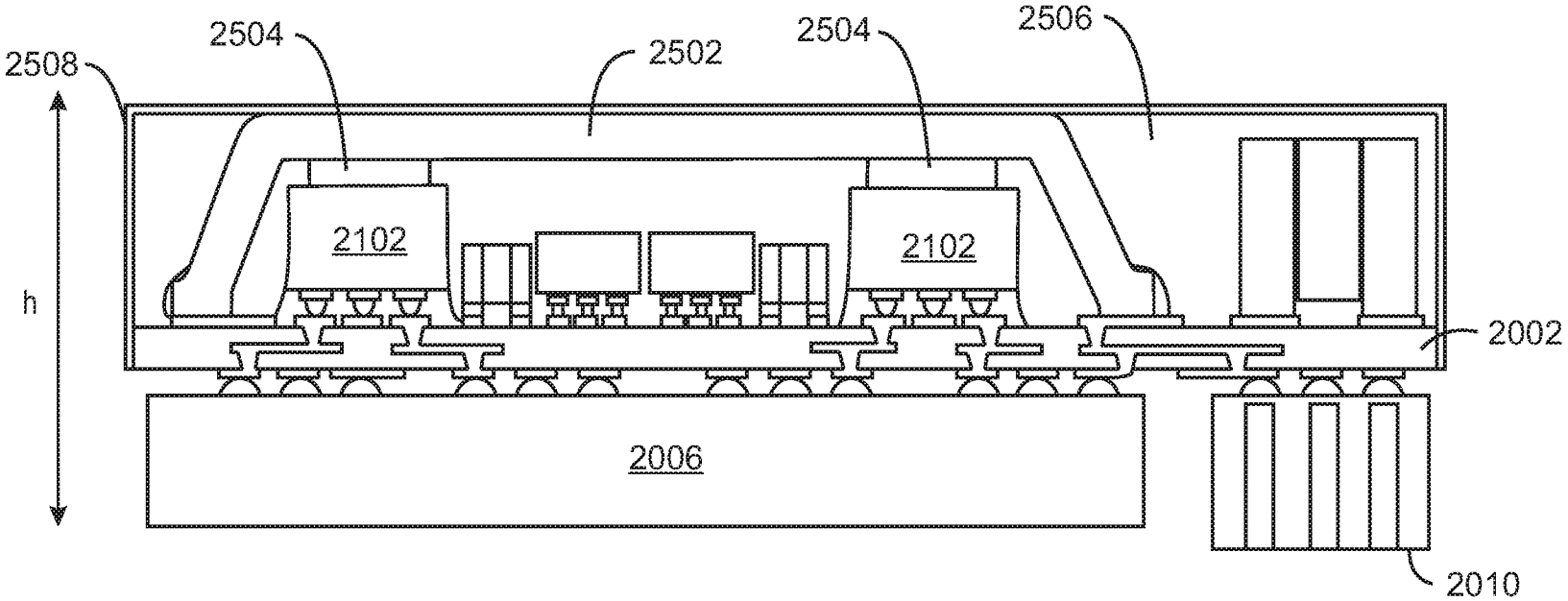

FIG. 25 is a diagram of another example layout of an RF module. The example RF module 2500 includes a multiple layer circuit board 2002, connectors 2010 and antennas 2006 on the bottom surface of the circuit board 2002 and the RFIC dies 2102 on the top side of the circuit board 2002. In this example, all of the RF module's antennas are disposed in an antenna module coupled to the bottom surface of the circuit board 2002. The antennas may be any suitable antenna type, including any of the antennas described herein. In some examples, the antennas are 5G antennas that cover all three of the mmWave frequency bands (24-29 GHz, 34-43 GHz, and 67-71 GHz).

To dissipate heat from the RFIC dies 2102, the RF module 2500 includes a metal heat sink 2502. The heat sink 2502 may be formed from a sheet of metal which is bent at the ends to form anchor points that can be soldered to the circuit board 2002 to hold the heat sink in place. The heat sink 2502 may be formed from any suitable type of metal including lead, copper, aluminum, and others. In some embodiments, the thickness of the heat sink 2502 may be approximately 0.25 mm. A layer of thermal compound 2504 may be disposed on the top surface of the RFIC dies 2102 to improve the thermal contact between the RFIC dies 2102 and the heat sink 2502. Additionally, an overmold 2506 covers the top side of the circuit board 2002. The overmold 2506 may be injected after the heatsink 2502 is anchored to the circuit board 2002.

The RF module 2500 also includes a conformal shield 2508 that covers the epoxy overmold 2506 and the heat sink 2502. The conformal shield 2508 may be sprayed over the top and side surfaces of the RF module, including the sides of the circuit board, after the overmold 2506 is deposited and cured. The conformal shield 2508 may be any suitable conductive material including copper, aluminum, conductive polymers, and others. The overmold 2506 provides mechanical stability and electrical isolation the top side circuit components, and also provides a support surface for application of the conformal shield 2508. In this embodiment, the overmold 2506 may be formed using a material with a low to medium thermal conductivity. For example, the thermal conductivity, k, may be approximately 0.1 to 1 watts per meter-kelvin. The overall height, h, of the RF module 2500 may be approximately 4.0 mm or less.

Figure 26:
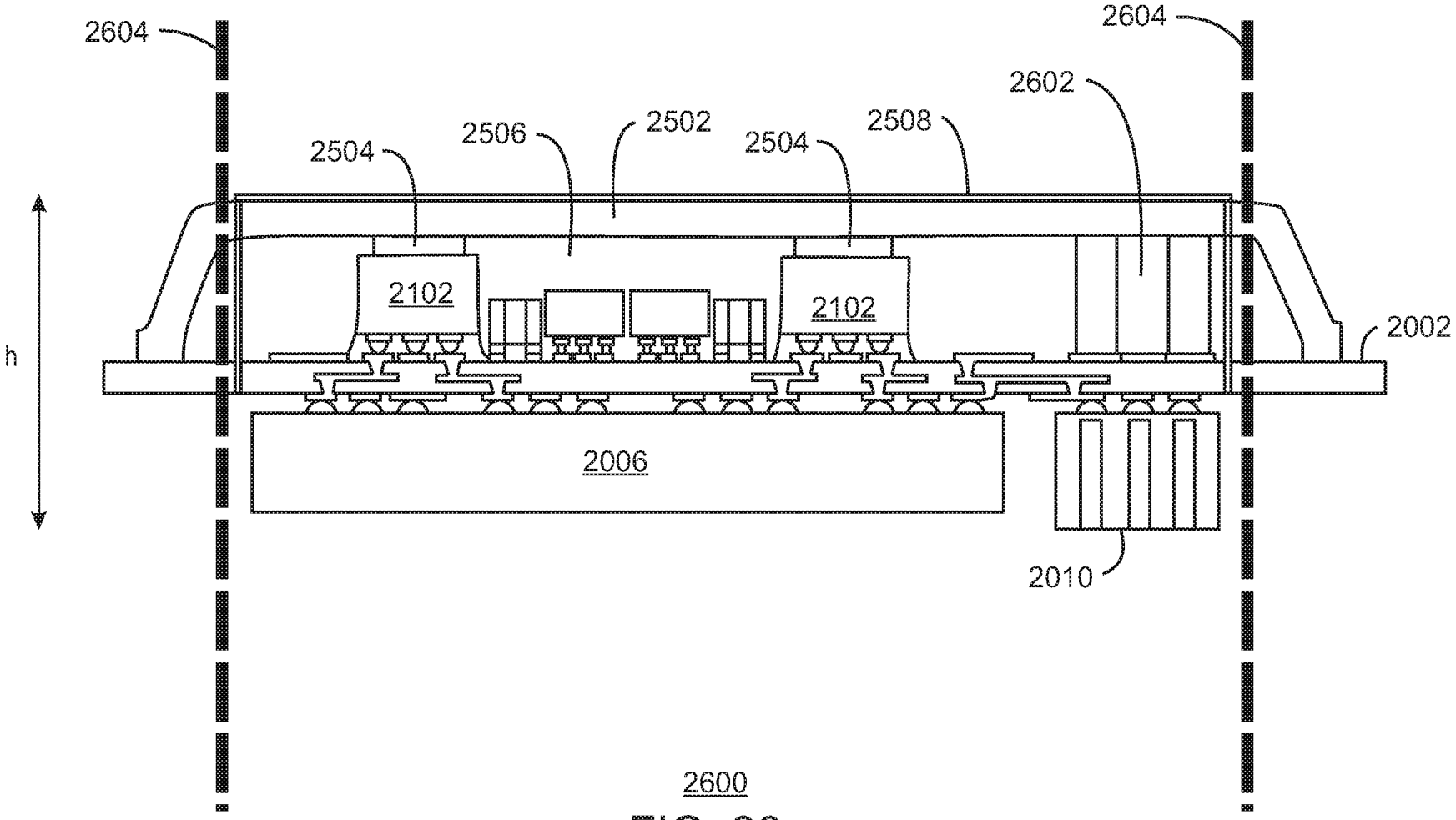

FIG. 26 is a diagram of another example layout of an RF module. The example RF module 2600 is similar to the RF module 2500 shown in FIG. 25 and includes the multiple layer circuit board 2002, the connectors 2010 and antennas 2006 on the bottom surface of the circuit board 2002 and the RFIC dies 2102 on the top side of the circuit board 2002. The RF module 2600 also includes a metal heat sink 2502 and layer of thermal compound 2504 disposed on the top surface of the RFIC dies 2102 to dissipate heat generated by the RFIC dies 2102. However, in this example, the heat sink 2502 covers the entire top surface of the RF module 2600 and also contacts other heat generating components, such as one or more capacitors 2602.

The heatsink 2502 may be formed by soldering the anchor points of the heatsink 2502 to the circuit board 2002. During this process, the circuit board is oversized to provide an excess circuit board area that allows the heatsink 2502 to be held in place, while the overmold material is injected. After the overmold 2506 is cured, the sides of the RF module 2600 can be cut along the dotted lines 2604. After cutting, the heatsink 2502 is held in place by the overmold material, which adheres to the bottom surface of the heatsink 2502.

The RF module 2600 also includes a conformal shield 2508 that covers the overmold 2506 and the heat sink 2502. The conformal shield 2508 may be sprayed or sputtered over the top and side surfaces of the RF module 2600, including the sides of the circuit board 2002, after the excess portions of the heat sink 2502 and circuit board 2002 are cut.

Figure 27:
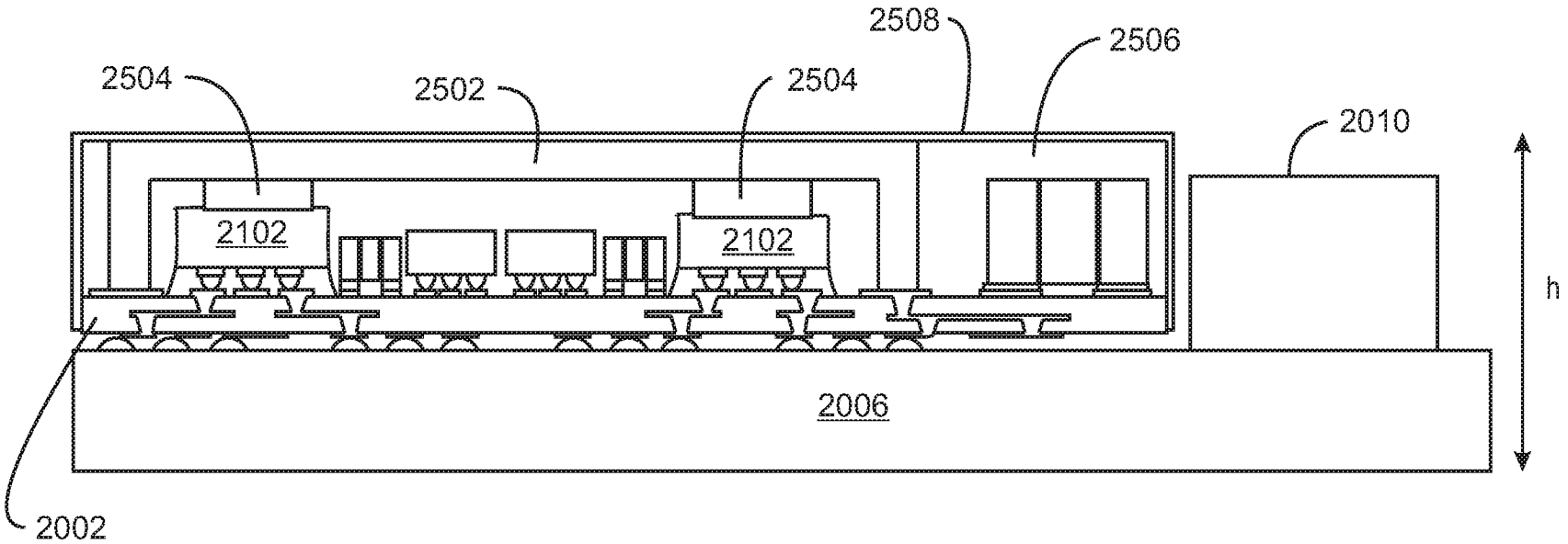

FIG. 27 is a diagram of another example layout of an RF module. The example RF module 2700 is similar to the RF module 2500 shown in FIG. 25 and includes the multiple layer circuit board 2002, antennas 2006 on the bottom surface of the circuit board 2002, and the RFIC dies 2102 on the top side of the circuit board 2002. In this example, all of the RF module's antennas are disposed on the bottom surface of the circuit board 2002. The antennas may be any suitable antenna type, including any of the antennas described herein. The RF module 2700 includes the metal heat sink 2502 anchored to the circuit board, and the conformal shield 2508 that covers the overmold 2506 and the heat sink 2502.

In this example, the antenna module 2006 is approximately 50 to 75 percent longer than the antenna module shown in FIG. 25. This enables the antenna module 2006 to support a larger antenna array. The larger RF module 2700 of FIG. 27 may be suitable for larger equipment such as laptop computers, WiFi or 5G base stations, and the like. The antenna module 2006 may include broadside or end-fire antennas such as 1×4 dual polarized dual band collated antenna array or broadband antennas. The overall height, h, of the RF module 2700 may be approximately the same as the height of the RF module 2500 shown in FIG. 25, while the length of the RF module may be approximately 20 mm or larger.

Additionally, since the antenna module 2006 is longer than the circuit board 2002, a more compact layout can be achieved by coupling the connectors 2010 to the top surface of the antenna module 2006. Interconnects within the antenna module 2006 communicatively couple the connectors 2010 to the associated circuitry on the top surface of the circuit board 2002.

Figure 28:
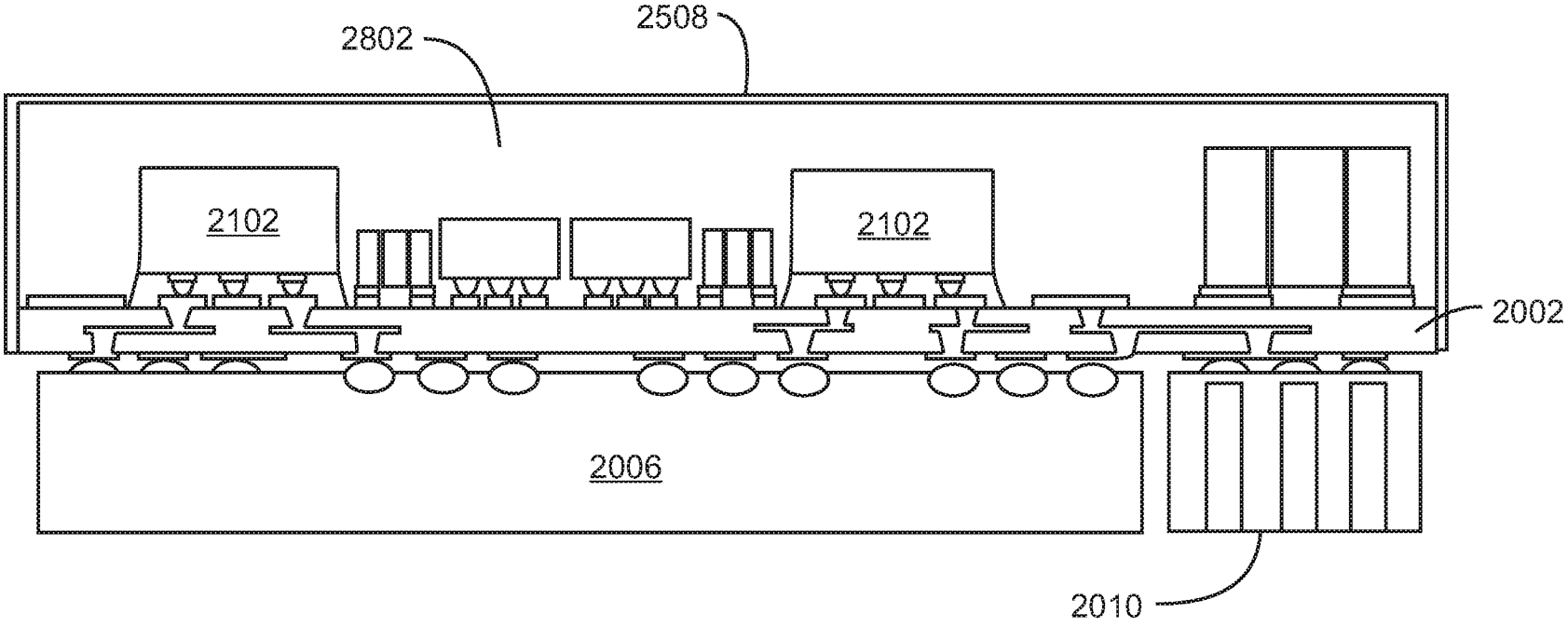

FIG. 28 is a diagram of another example layout of an RF module. The example RF module 2800 is similar to the RF module 2600 shown in FIG. 26 and includes all of the same components described in relation to FIG. 26, except for the heatsink. In place of the heatsink, the overmold 2802 is made of a high thermal conductivity material. For example, the thermal conductivity, k, of the overmold 2802 may be 1 to 5 watts per meter-kelvin. In addition to providing a support surface for application of the conformal shield 2508 and mechanical stability and electrical isolation for the top side circuit components, the overmold 2802 shown in FIG. 28 also serves to dissipate heat generated by the RFIC dies 2102 and other circuit components.

Figure 29:
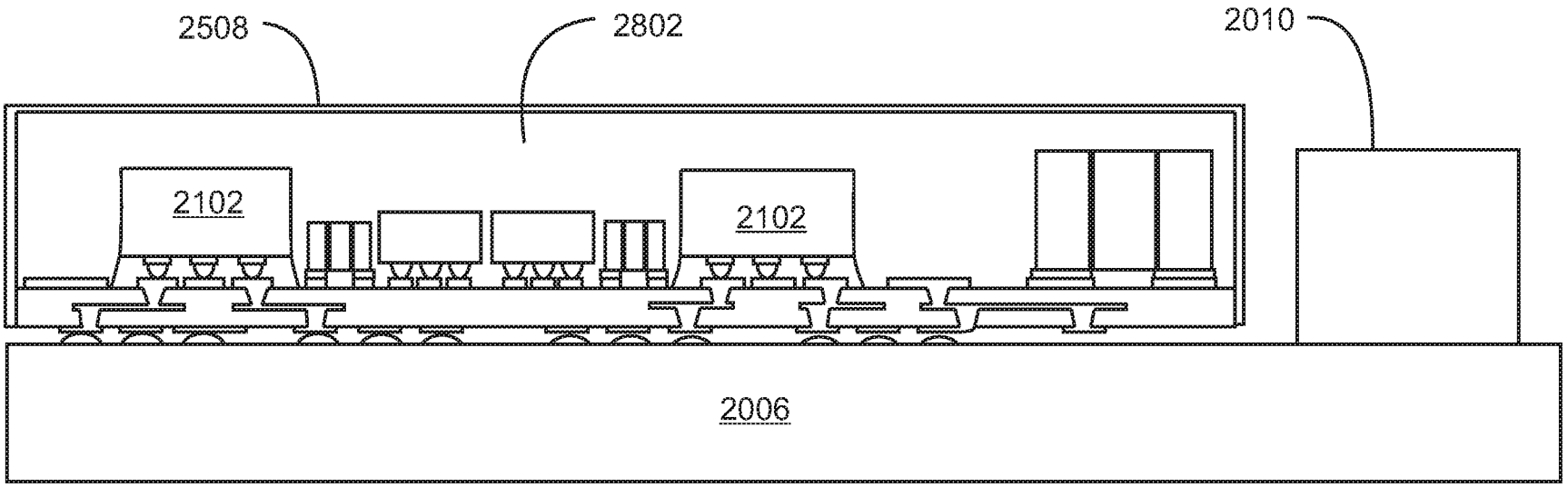

FIG. 29 is a diagram of another example layout of an RF module. The example RF module 2900 is similar to the RF module 2700 shown in FIG. 27 and includes all of the same components described in relation to FIG. 27, except for the heatsink. As described in relation to FIG. 28, the overmold 2802 is made of a high thermal conductivity material to provide heat dissipation for the RFIC dies 2102 and other circuit components.

Figure 30:
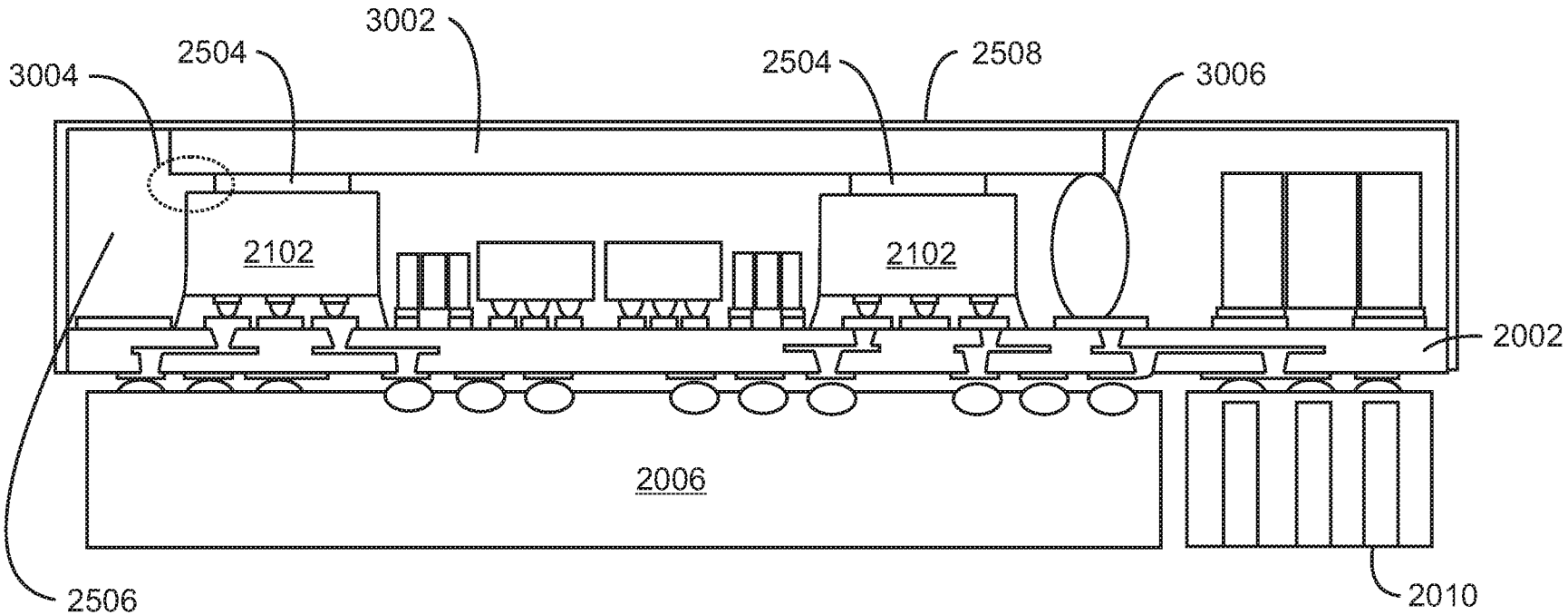

FIG. 30 is a diagram of another example layout of an RF module. The example RF module 3000 is similar to the RF module 2500 shown in FIG. 25 and includes all of the same components described in relation to FIG. 25. However, in the embodiment shown in FIG. 30, the heatsink 3002 is a flat metal sheet that sits over the RFIC dies 2102 with a layer of thermal compound 2504 disposed between the heatsink 3002 and the RFIC dies 2102. Thus, the embodiment shown in FIG. 30 does not include the portion of the heatsink that acts as an anchor. The RF module 3000 also includes the overmold 2506. In some embodiments, the heatsink 3002 may be held in place by lip 3004 of overmold material, which surrounds the thermal compound and serves as an adhesive between the RFIC die 2102 and the heatsink 3002. In some embodiments, the heatsink 3002 may be held in place by a solder ball 3006 coupled between the circuit board 2002 and one or both edges of the heatsink 3002.

Figure 31:
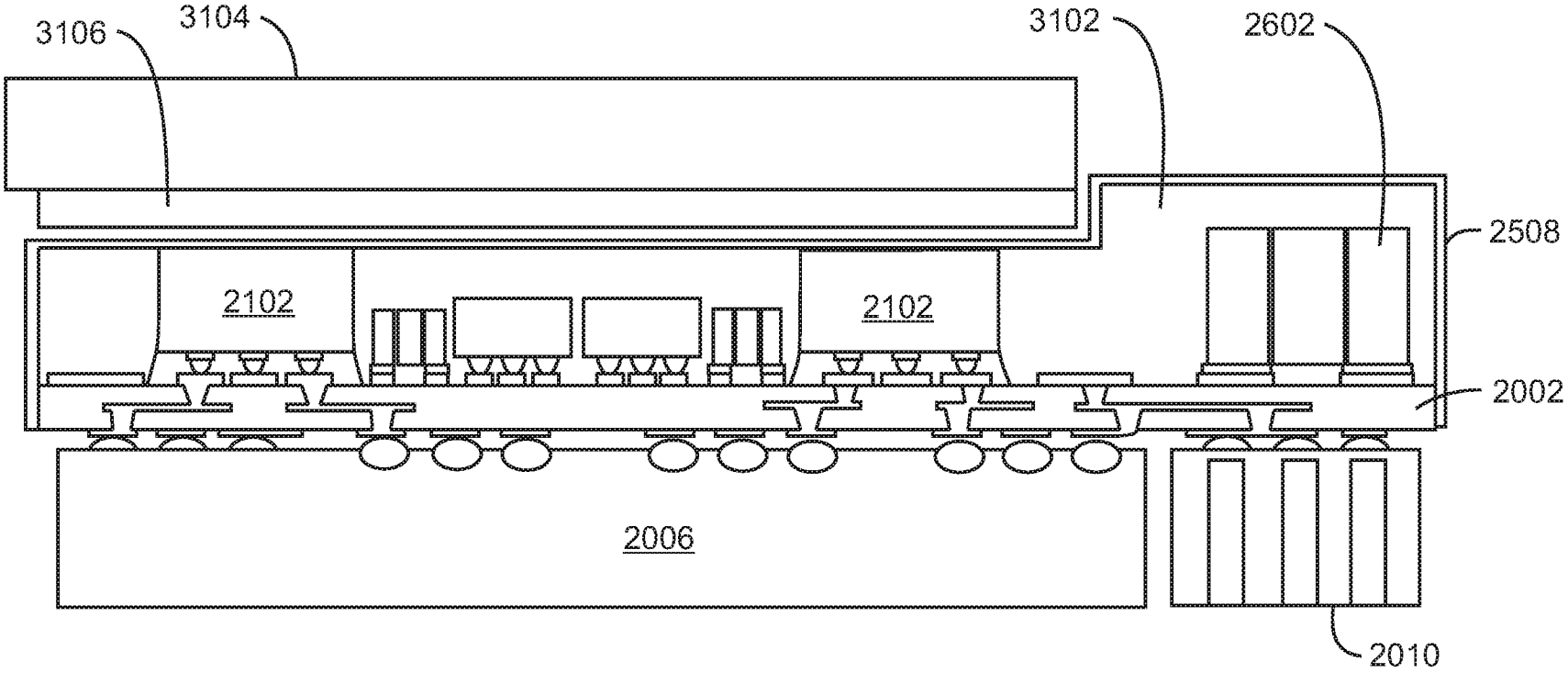

FIG. 31 is a diagram of another example layout of an RF module. The example RF module 3100 is similar to the RF module 3000 shown in FIG. 30 and includes all of the same components described in relation to FIG. 25, except for the heatsink. Instead of a heatsink, the overmold 3102 is shaped such that the overmold is not disposed over the top of the RFIC dies 2102. As show in FIG. 31, the overmold 3102 may also have a step in height to cover other components such as the capacitors 2602. The conformal shield 2508 covers the overmold 3102 and is in contact with the top surface of the RFIC dies 2102. This enables heat generated by the RFIC dies 2102 to escape through the thin layer of conformal shield material. The configuration shown in FIG. 31 enables the RF module 3100 to be manufactured without the inclusion of the heatsink, but also allows for another heatsink 3104 be added later along with a layer of thermal compound 3106.

Figure 32:
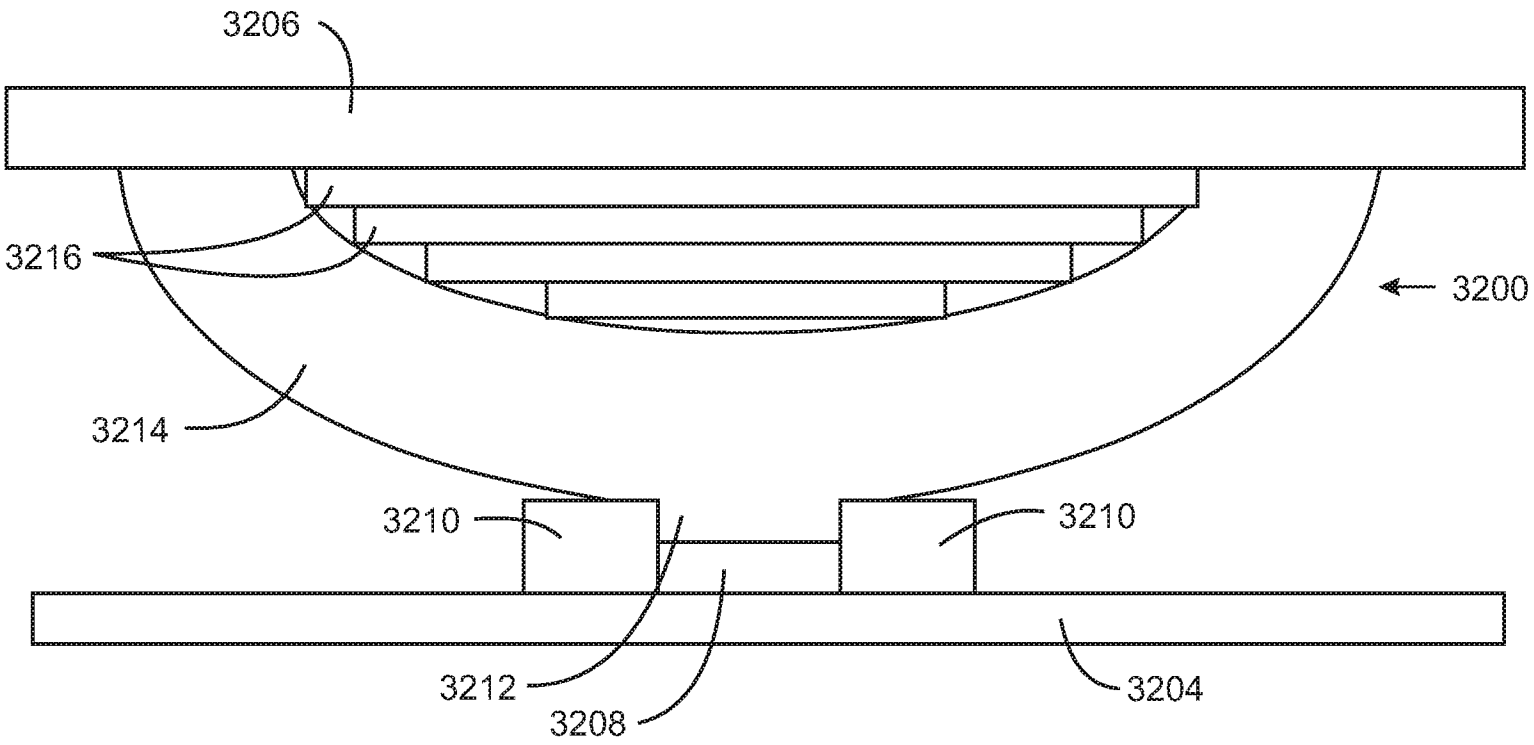
FIG. 32 is a diagram of an example heat spreader.

FIG. 32 is a diagram of an example heat spreader. The heat generated inside a mobile device such as a smart phone may tend to be concentrated at specific components, such as RFIC dies. In some cases, the heat may be dissipated through the use of a heatsink that provides a thermally conductive path from the heat generating element to an external surface of the device. However, the use of such as heatsink may tend to cause a hot spot on the outer surface of the device.

The heat spreader 3200 shown in FIG. 32 is configured to avoid creating a hot spot on the outer surface of the electronic device. The heat spreader 3200 may be included in an electronic device such as a smart phone, for example. The example device in FIG. 32 includes a circuit board 3204, a chassis 3206, and a die 3208 such as an RFIC die surrounded by an overmold 3210. It will be appreciated that the electronic device will include many additional components, which, for the sake of simplicity, are not shown in FIG. 32. It will also be appreciated that the electronic device may include a plurality of dies each coupled to a separate heat spreader 3200. In this way, heat can be spread more evenly across the surface area of the chassis without creating hot spots.

The heat spreader 3200 is thermally coupled to the top surface of the die 3208 to conduct heat from the die 3208 to the chassis 3206. In some embodiments, the overmold 3210 may from a recess over the die 3208, such that the recess enables the heat spreader 3200 to be aligned with the die 3208. The heat spreader 3200 may include a pedestal 3212 that fits within the overmold recess to make contact with the die 3208. In some examples, the overmold 3210 may be adhered to the pedestal to prevent movement of the heat spreader 3200. The heat spreader 3200 also includes a flared portion 3214 that conducts the heat laterally away from the die 3208 toward chassis 3206. Additionally, as shown in FIG. 32, the heat spreader 3200 may be shaped to form an air gap directly above the die 3208, which will tend to inhibit the flow of heat to the chassis 3206 directly above the die 3208. In this way, heat generated by the die 3208 can be dissipated over a larger area of the chassis 3206 rather than simply being dissipated through the shortest distance path between the die 3208 and the chassis 3206.

In some embodiments, the air gap may be filled with an insulating material, which further inhibits the flow of heat across the air gap and adds rigidity to the electronic device. As shown in FIG. 32, the insulating material may include several layers of insulating film 3216 such as Polytetrafluoroethylene (PTFE), expanded PTFE (ePTFE), silica aerogel, and composites thereof. Other thermal insulators can also be used, such as porous polymer foams, and others.

Figure 33:
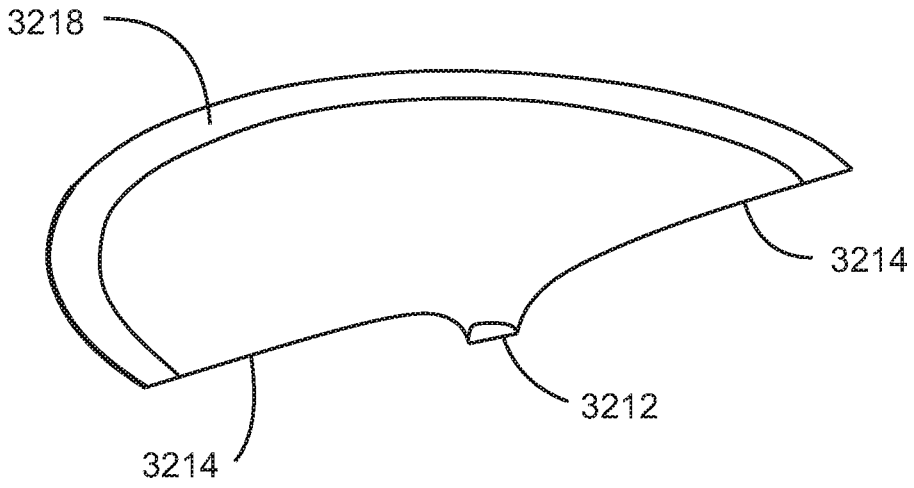
FIG. 33 is a cross sectional perspective view of an example heat spreader.

FIG. 33 is a cross sectional perspective view of an example heat spreader. The heat spreader 3200 includes the pedestal 3212 and the flared portion 3214, which together conduct heat away from the heat generating component to the chassis. The flared portion 3214 may be approximately 200 mm in diameter depending on the available space within the electronic device in which it is used. The heat spreader 3200 also includes a flat contact portion 3218 that transfers the heat from the heat spreader 3200 to the chassis 3206. The total surface area of the flat portion may be approximately 2×2 mm or larger. The flat contact portion 3218 may be in direct contact with the chassis 3206 or separated from the chassis 3206 by a small air gap. The heat spreader 3200 may be made of any suitable thermally conductive material including copper, aluminum, stainless steel, graphite, and others. The heat spreader 3200 may be formed through injection molding, metal stamping, and other techniques.

Figure 34:
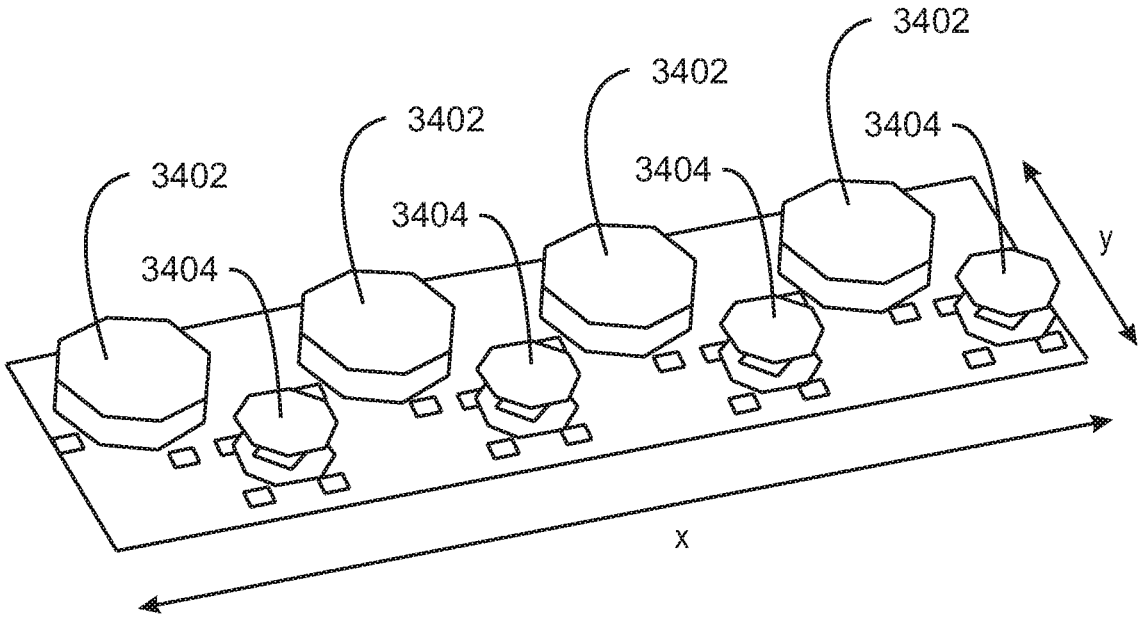
FIG. 34 is a perspective view of an antenna module.

FIG. 34 is a perspective view of an antenna module. The antenna module 3400 shown in FIG. 34 may be the same as antenna module 2406 shown in FIGS. 25-31. The antenna module 3400 includes a plurality of patch antennas formed in a four layer stack-up. The overall height of the antenna module 3400 may be approximately 1 millimeter, the length in the x direction may be approximately 18 mm, and the length in the y direction may be approximately 5 mm. However, other dimensions are possible depending on various factors such as the resonant frequency of the antennas.

The antenna module includes four low-band patch antennas 3402 formed as a 1×4 array, and four high-band patch antennas formed as an additional 1×4 array. Each antenna may include four input terminals, such that two of the input terminals is used to feed a first polarization and the other two input terminals are used for a second polarization. The antennas may be fed using the feed system shown in FIG. 35.

Figure 35:
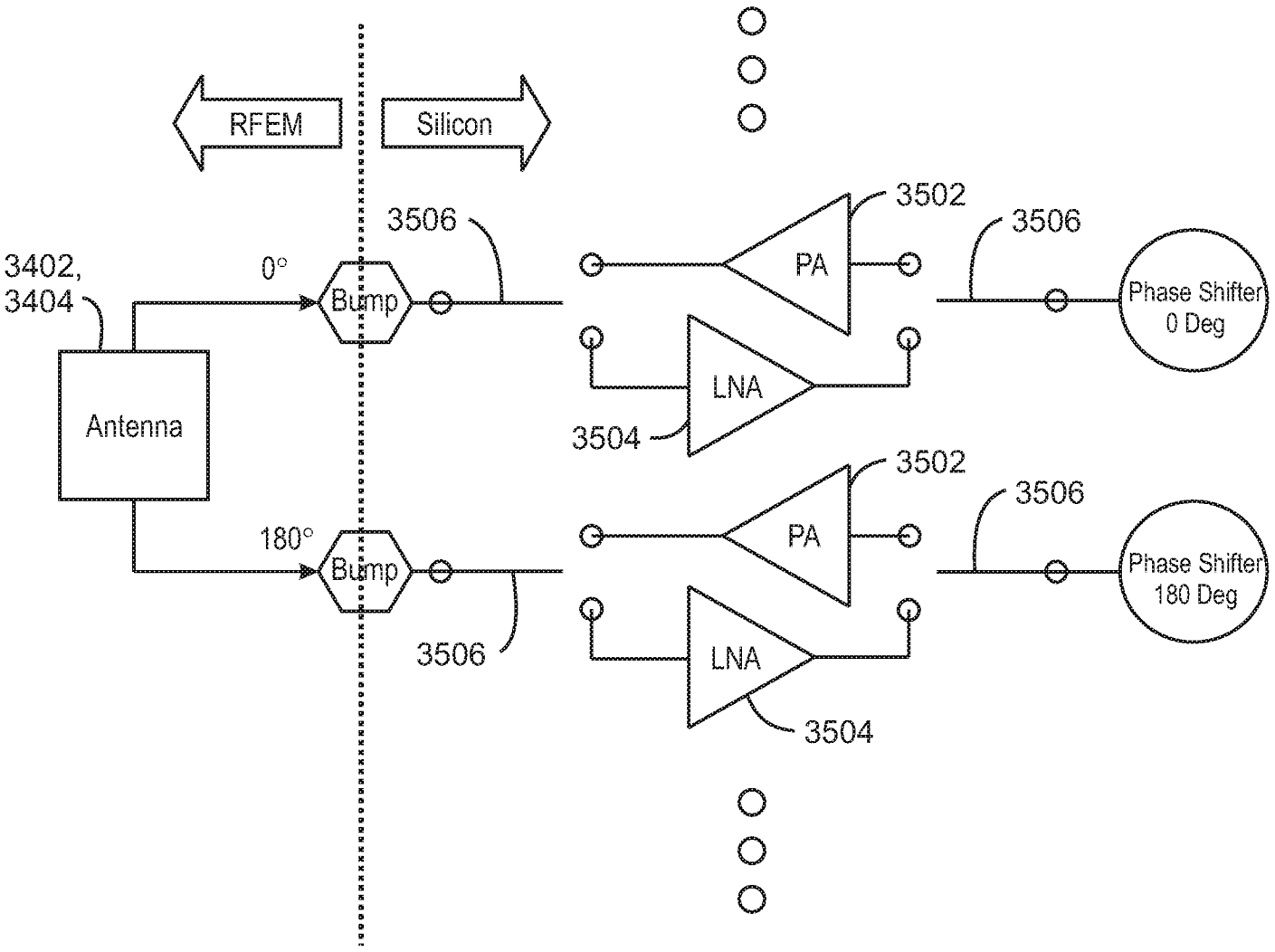
FIG. 35 is an example feed system for an antenna module.

FIG. 35 is an example feed system for an antenna module such as the antenna module shown in FIG. 34. FIG. 35 shows a portion of the feed system 3500 that may be used to feed a single polarization for a single antenna such as the patch antennas 3402 and 3404. The components of the feed system shown in FIG. 35 may be duplicated for each polarization of each antenna.

The feed system 3500 includes a pair of power amplifiers 3502 for delivering electrical signals to the corresponding antenna and a pair of low noise amplifiers 3504 for receiving electrical signals from the corresponding antenna. During data transmission, the output of the power amplifiers 3502 are both coupled to the antenna though a set of switches 3506, such that both power amplifiers 3502 simultaneously deliver complimentary signals to the antenna. The power amplifiers 3502 receive complimentary driving signals, which are shifted 180 degrees in phase relative to one another. This enables the power amplifiers 3502 to deliver a differential signal to each antenna through a pair of power amplifiers rather than a single amplifier, thereby increasing the power output by 3 dB. The signals sent to the power amplifiers 3502 may be shifted in phase by feeding the power amplifiers 3502 through signal traces that have a length difference suitable to provide the 180 degree phase shift.

During data reception, both of the low noise amplifiers 3504 will be coupled the antenna simultaneously and will receive complimentary signals, i.e., shifted by 180 degrees. The output of the low noise amplifiers will then be shifted by 180 degrees before being added together, thereby increasing the amplitude of the received signal by 3 dB.

In addition to increasing the power output and power input, the feed system 3500 also improves the polarization discrimination of the antenna module. As used herein, polarization discrimination refers to the level at which the signals of one polarization will tend to be transferred to the other polarization in a dual polarized antenna. The polarization discrimination provided by the described system may be greater than approximately 20 dB.

Figure 36:
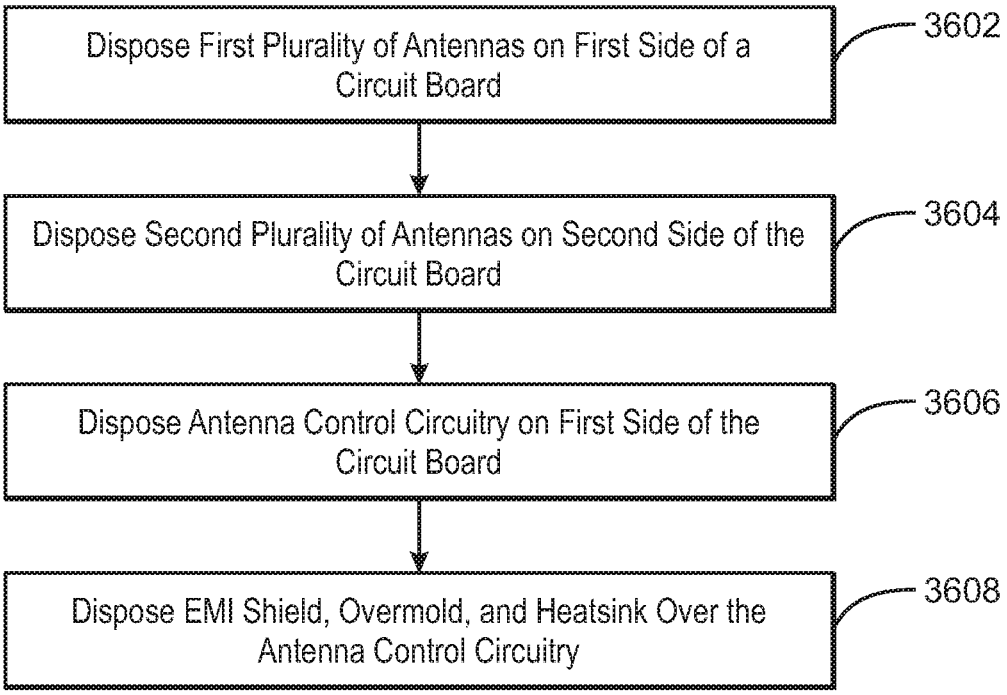
FIG. 36 is a process flow diagram summarizing a method to fabricate an RF communication module.

FIG. 36 is a process flow diagram summarizing a method to fabricate an RF module. The method 3600 may be used to fabricate any of the RF modules described herein. The method may begin at block 3602.

At block 3602, a first plurality of antennas is disposed on a first side of a circuit board. The first plurality of antennas may be broadband antennas with a bandwidth of approximately 40 percent. In some embodiments, the antennas may operate over a frequency range of 24 GHz to 43 GHz. The antennas may also be broadside antennas, end-fire antennas, dual broadside and end-fire antennas, or a combination thereof.

At block 3604, a second plurality of antennas is disposed on a second side of the circuit board. The second plurality of antennas may be broadband antennas with a bandwidth of approximately 40 percent. The antennas may also be broadside antennas, end-fire antennas, dual broadside and end-fire antennas, or a combination thereof.

At block 3606, antenna control circuitry is disposed on the first side of the circuit board. The antenna control circuitry can include one or more Radio Frequency Integrated Circuit (RFIC) dies and additional circuitry as described above. In some embodiments, the RFIC dies may be disposed in a recess formed in the circuit board.

At block 3608, an Electromagnetic Interference (EMI) shield is disposed over the antenna control circuitry. Disposing the EMI shield may include disposing an epoxy overmold over the antenna control circuitry and forming a conformal shield over the epoxy overmold by spraying or sputtering an electrically conductive material over the overmold. The epoxy overmold may have a thermal conductivity, k, greater than 1.0 Watts per meter Kelvin in embodiments in which the overmold serves to conduct heat away from the RFIC dies. The epoxy overmold may have a thermal conductivity, k, less than 1.0 Watts per meter Kelvin in embodiments in which the overmold is not used to conduct heat away from the RFIC dies.

Also at block 3608, a heatsink may optionally be disposed over the RFIC dies. In some embodiments, the heatsink may be held in place by coupling the heatsink to the circuit board at two or more anchor points, while the epoxy overmold is injected over the antenna control circuitry, such that at least a portion of the epoxy overmold fills the space between the heatsink and the antenna control circuitry.

The method 3600 should not be interpreted as meaning that the blocks are necessarily performed in the order shown. Furthermore, fewer or greater actions can be included in the method 3600 depending on the design considerations of a particular implementation.

Some embodiments may be implemented in one or a combination of hardware, firmware, and software. Some embodiments may also be implemented as instructions stored on the tangible non-transitory machine-readable medium, which may be read and executed by a computing platform to perform the operations described. In addition, a machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

It is to be understood that specifics in the aforementioned examples may be used anywhere in one or more embodiments. For instance, all optional features of the computing device described above may also be implemented with respect to either of the methods or the computer-readable medium described herein. Furthermore, although flow diagrams and/or state diagrams may have been used herein to describe embodiments, the techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An Radio Frequency (RF) communication module for a hand-held mobile electronic device, comprising:

a circuit board;

a plurality of antennas disposed on a top side and bottom side of the circuit board, wherein the plurality of antennas comprise a first subset of antennas comprising end-fire antennas and a second subset of antennas comprising broadside antennas; and a shielded area comprising circuitry coupled to the circuit board for controlling the antennas;

wherein the first subset of antennas and the second subset of antennas have a bandwidth of approximately 40 percent.

2. The RF communication module of claim 1, wherein the end-fire antennas comprise at least one end-fire open slot antenna.

3. The RF communication module of claim 1, wherein the end-fire antennas comprise at least one dual polarized end-fire open slot antenna.

4. The RF communication module of claim 1, wherein the end-fire antennas comprise at least one periodic bowtie antenna printed on a dielectric substrate.

5. The RF communication module of claim 1, wherein the circuitry for controlling the antennas comprises a Radio Frequency Integrated Circuit (RFIC) die, and the shielded area comprises a heatsink anchored to the circuit board and contacting a top surface of the RFIC die.

6. The RF communication module of claim 1, wherein the circuitry for controlling the antennas comprises a plurality of Radio Frequency Integrated Circuit (RFIC) die disposed in a recess of the circuit board.

7. The RF communication module of claim 1, wherein the shielded area comprises an epoxy overmold disposed over the circuitry and a conformal shield disposed over the epoxy overmold.

8. The RF communication module of claim 7, wherein the conformal shield is sprayed or sputtered over the epoxy overmold.

9. The RF communication module of claim 1, wherein the circuitry for controlling the antennas comprises a Radio Frequency Integrated Circuit (RFIC) die, and wherein the RF communication module comprises a heat spreader comprising a pedestal thermally coupled to the RFIC die and a flared portion thermally coupled to an external surface of the hand-held mobile electronic device.

10. The RF communication module of claim 1, wherein at least one of the plurality of antennas is fed by a pair of transmitters, the pair of transmitters comprising a first transmitter coupled to a first input of the antenna and second transmitter coupled to a second input of the antenna, wherein the first transmitter and the second transmitter deliver a differential signal to the antenna.

11. The RF communication module of claim 1, wherein the first subset of antennas have a 24 GHz to 33 GHz frequency range and the second subset of antennas have a 37 GHz-43 GHz frequency range.

12. The RF communication module of claim 1, wherein the first subset of antennas and the second subset of antennas have a 24 GHz to 43 GHz frequency range.

13. The RF communication module of claim 1, wherein an overall thickness of the RF communication module is less than or equal to two millimeters.

14. The RF communication module of claim 1, comprising one or more connectors to couple the circuitry to a control interface of the hand-held mobile electronic device, wherein the RF communication module does not include any externally exposed solder connections.

15. A method of fabricating an RF communication module, comprising:

disposing a first plurality of antennas on a first side of a circuit board;

disposing a second plurality of antennas on a second side of the circuit board;

disposing antenna control circuitry in the first side of the circuit board; and disposing an Electromagnetic Interference (EMI) shield over the antenna control circuitry;

wherein the first plurality of antennas and the second plurality of antennas have a bandwidth of approximately 40 percent and comprise broadside and end-fire antennas.

16. The method of claim 15, wherein disposing the EMI shield comprises disposing an epoxy overmold over the antenna control circuitry and forming a conformal shield over the epoxy overmold.

17. The method of claim 16, wherein the epoxy overmold has a thermal conductivity, k, greater than 1.0 Watts per meter Kelvin.

18. The method of claim 16, wherein the conformal shield is formed by sputtering or spraying conductive material over the epoxy overmold.

19. The method of claim 15, wherein the antenna control circuitry comprises a Radio Frequency Integrated Circuit (RFIC) die, the method comprising:

disposing a heatsink over the RFIC die;

soldering the heatsink to the circuit board at two or more anchor points; and after soldering the heatsink to the circuit board, injecting an epoxy overmold over the antenna control circuitry, wherein at least a portion of the epoxy overmold fills a space between the heatsink and the antenna control circuitry.

20. The method of claim 19, wherein the epoxy overmold has a thermal conductivity, k, less than 1.0 Watts per meter Kelvin.

21. The method of claim 15, wherein the antenna control circuitry comprises a Radio Frequency Integrated Circuit (RFIC) die, the method comprising forming a recess in the circuit board and disposing the RFIC die in the recess.

22. The method of claim 15, wherein the antenna control circuitry comprises a plurality of transmitter pairs, wherein each transmitter pair is to transmit a differential signal to at least one of the first plurality of antennas and second plurality of antennas.

23. The method of claim 15, wherein the first plurality of antennas and the second plurality of antennas have a 24 GHz to 43 GHz frequency range, and an overall thickness of the RF communication module is less than or equal to two millimeters.

24. A hand-held mobile electronic device, comprising:

a main circuit board comprising a main controller of the hand-held mobile electronic device; and an RF communication module comprising:

a module circuit board;

a plurality of antennas disposed on a top side and bottom side of the module circuit board, wherein the plurality of antennas comprise a first subset of antennas comprising end-fire antennas and a second subset of antennas comprising broadside antennas;

antenna control circuitry coupled to the module circuit board;

an epoxy overmold covering the antenna control circuitry;

a conformal shield sprayed or sputtered over a surface of the epoxy overmold to provide an Electromagnetic Interference (EMI) shield over the antenna control circuitry; and one or more connectors coupled to the top side or bottom side of the module circuit board and configured to communicatively couple the antenna control circuitry to the main controller.

25. The hand-held mobile electronic device of claim 24, wherein the antenna control circuitry comprises a plurality of Radio Frequency Integrated Circuit (RFIC) dies, the RF communication module comprising a U-shaped heatsink anchored to the module circuit board and contacting a top surface of the RFIC die.

* * * * *